US010120327B2

(12) United States Patent
Shiohara et al.

(10) Patent No.: US 10,120,327 B2
(45) Date of Patent: Nov. 6, 2018

(54) RECORDING APPARATUS

(71) Applicant: SEIKO EPSON CORPORATION, Tokyo (JP)

(72) Inventors: Hiroshi Shiohara, Shiojiri (JP); Satoshi Iwaya, Ina (JP); Koji Migita, Matsumoto (JP); Hiroyuki Yoda, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/394,293

(22) Filed: Dec. 29, 2016

(65) Prior Publication Data

US 2017/0192385 A1 Jul. 6, 2017

(30) Foreign Application Priority Data

Jan. 5, 2016 (JP) ..... 2016-000674

(51) Int. Cl.
*G03G 21/16* (2006.01)
*G03G 15/00* (2006.01)

(52) U.S. Cl.
CPC ..... *G03G 21/1633* (2013.01); *G03G 15/5016* (2013.01)

(58) Field of Classification Search
CPC ..... H04N 2201/0094; H04N 1/00551; H04N 1/00554; B41J 29/02; G03G 21/1628
See application file for complete search history.

(56) References Cited

U.S. PATENT DOCUMENTS

2014/0071498 A1* 3/2014 Ishida ..... H04N 1/00496 358/296
2015/0077815 A1* 3/2015 Okazawa ..... H04N 1/00551 358/474

FOREIGN PATENT DOCUMENTS

| | | |
|---|---|---|
| JP | 2005-189552 | 7/2005 |
| JP | 2010-134356 | 6/2010 |
| JP | 2013-157799 | 8/2013 |

* cited by examiner

*Primary Examiner* — David M Gray
*Assistant Examiner* — Jessica L Eley
(74) *Attorney, Agent, or Firm* — Workman Nydegger

(57) ABSTRACT

A recording apparatus includes a recording mechanism unit, an opening/closing unit that is rotatably coupled to the recording mechanism unit in an upper portion of the recording mechanism unit, an operation unit which is arranged to face a circumferential edge of the opening/closing unit and is able to have a coupling state in which the operation unit and the opening/closing unit are coupled together and a released state in which the coupling state is released, a cable that connects a control unit with the operation unit, and a support means which is provided in the recording mechanism unit and which supports the operation unit that is in the released state and is connected to the control unit by the cable in a state in which a distance between the operation unit and the circumferential edge of the opening/closing unit is greater than that in the coupling state.

9 Claims, 20 Drawing Sheets

RECORDING APPARATUS

CROSS REFERENCES TO RELATED APPLICATIONS

The entire disclosure of Japanese Patent Application No. 2016-000674, filed Jan. 5, 2016 is expressly incorporated by reference herein.

BACKGROUND

1. Technical Field

The present invention relates to a recording apparatus including a recording mechanism unit that has a recording means that performs recording on a recording medium and an opening/closing unit that is rotatably coupled to the recording mechanism unit in an upper portion of the recording mechanism unit and rotates to open and close the upper portion of the recording mechanism unit.

2. Related Art

Recording apparatuses represented by a facsimile and a printer include a so-called complex machine that has an image reading function in addition to a recording function. In the complex machine, a scanner unit is provided above a main body that performs recording on a recording paper.

The scanner unit is rotatably provided to the recording mechanism unit and can rotate to switch between an open posture and a closed posture. The scanner unit is held in the closed posture in a normal operation. However, the scanner unit is opened, for example, when paper jam occurs inside the recording mechanism unit and the jammed paper is removed, when an ink cartridge is replaced, and when other maintenance operations are performed.

JP-A-2005-189552 is an example of related art.

By the way, the complex machine as described above is usually provided with an operation panel for operating the scanner unit and the recording mechanism unit.

However, if the operation panel is adjacent to the scanner unit, for example, when a rotating shaft of the scanner unit is wobbly, there is a risk that the scanner unit and the operation panel interfere with each other when opening the scanner unit. Therefore, it is necessary to remove the operation panel from an installation position before opening the scanner unit.

However, when the operation panel has been removed, for example, it is not possible to test-operate the recording mechanism unit in a state in which the scanner unit is opened, sot that the effectiveness of maintenance of the recording mechanism unit is lowered. Therefore, it is not preferable.

SUMMARY

An advantage of some aspects of the invention is to provide a recording apparatus with higher maintainability.

A recording apparatus according to a first aspect of the invention to solve the problem described above is characterized by including a recording mechanism unit including a recording means that performs recording on a recording medium, an opening/closing unit that is rotatably coupled to the recording mechanism unit in an upper portion of the recording mechanism unit and rotates to open and close the upper portion of the recording mechanism unit, an operation unit which receives an operation to the recording mechanism unit and which is arranged to face a circumferential edge of the opening/closing unit and is provided to be able to have a coupling state in which the operation unit and the opening/closing unit are coupled together and a released state in which the coupling state between the operation unit and the opening/closing unit is released, a cable that connects a control unit that controls the recording mechanism unit with the operation unit, and a support means which is provided in the recording mechanism unit and which supports the operation unit that is in the released state and is connected to the control unit by the cable in a state in which a distance between the operation unit and the circumferential edge of the opening/closing unit is greater than that in the coupling state.

According to this aspect, the recording apparatus includes a support means which is provided in the recording mechanism unit and which supports the operation unit that is in the released state and is connected to the control unit by the cable in a state in which a distance between the operation unit and the circumferential edge of the opening/closing unit is greater than that in the coupling state. Therefore, in a state in which the operation unit is supported by the support means, it is possible to appropriately open the opening/closing unit while avoiding interference between the operation unit and the opening/closing unit when opening the opening/closing unit.

Further, when the operation unit is in the released state, it is possible to temporarily support the operation unit by the recording mechanism unit without placing the operation unit at a position away from the recording mechanism unit and it is possible to maintain a state in which the operation unit and the control unit are connected by the cable, so that it is possible to operate the recording mechanism unit by the operation unit even when the opening/closing unit is opened.

Because of the above, it is possible to obtain a recording apparatus with higher maintainability.

A second aspect of the invention is characterized in that, in the first aspect, an operation surface of the operation unit is inclined in the coupling state, and when the operation unit is supported by the support means, the operation surface is inclined in the same direction as that in the coupling state.

According to this aspect, the operation surface of the operation unit is inclined in the coupling state, and when the operation unit is supported by the support means, the operation surface is inclined in the same direction as that in the coupling state. Therefore, the operability of the operation unit does not vary so much between the coupling state and a state in which the operation unit is supported by the support means, and therefore good operability can be maintained.

A third aspect of the invention is characterized in that, in the first and the second aspects, the operation unit has a fixing portion that is fixed to the recording mechanism unit in the coupling state, and the operation unit is supported by the support means when the fixing portion engages with the support means.

According to this aspect, the operation unit is not only coupled with the opening/closing unit but also fixed to the recording mechanism unit, so that it is possible to more reliably fix the operation unit, suppress rattling during operation, and provide good operation feeling.

A fourth aspect of the invention is characterized in that, in the third aspect, the fixing portion is formed as a protrusion portion that protrudes downward of the apparatus on a side of the operation unit that faces the opening/closing unit, and the support means includes a hook portion that hooks the fixing portion.

According to this aspect, the fixing portion is formed as a protrusion portion that protrudes downward of the apparatus on a side of the operation unit that faces the opening/ closing unit, and the support means includes a hook portion that hooks the fixing portion, so that a structure in which the operation unit is supported by the support means is simplified, and therefore the support means can be formed at low cost.

A fifth aspect of the invention is characterized in that, in the third and the fourth aspects, a coupling portion that is coupled with the opening/closing unit in the operation unit is provided in an upper portion of the operation unit and the fixing portion is provided in a lower portion of the operation unit.

According to this aspect, the coupling portion that is coupled with the opening/closing unit in the operation unit is provided in an upper portion of the operation unit and the fixing portion is provided in a lower portion of the operation unit, so that the posture of the opening/closing unit is further stabilized in a state in which the operation unit is coupled to the opening/closing unit.

A sixth aspect of the invention is characterized in that, in the first and the second aspects, the support means is provided below the opening/closing unit, which is in an opened state, and above the recording mechanism unit.

According to this aspect, the support means is provided below the opening/closing unit, which is in an opened state, and above the recording mechanism unit, so that it generates a preferred state for operating the operation unit while viewing the inside of the recording mechanism unit and therefore it is possible to efficiently perform a maintenance operation.

A seventh aspect of the invention is characterized in that, in any one of the first to the sixth aspects, the opening/closing unit includes a reading mechanism unit that reads a document and a feed mechanism unit that automatically feeds a document to the reading mechanism unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
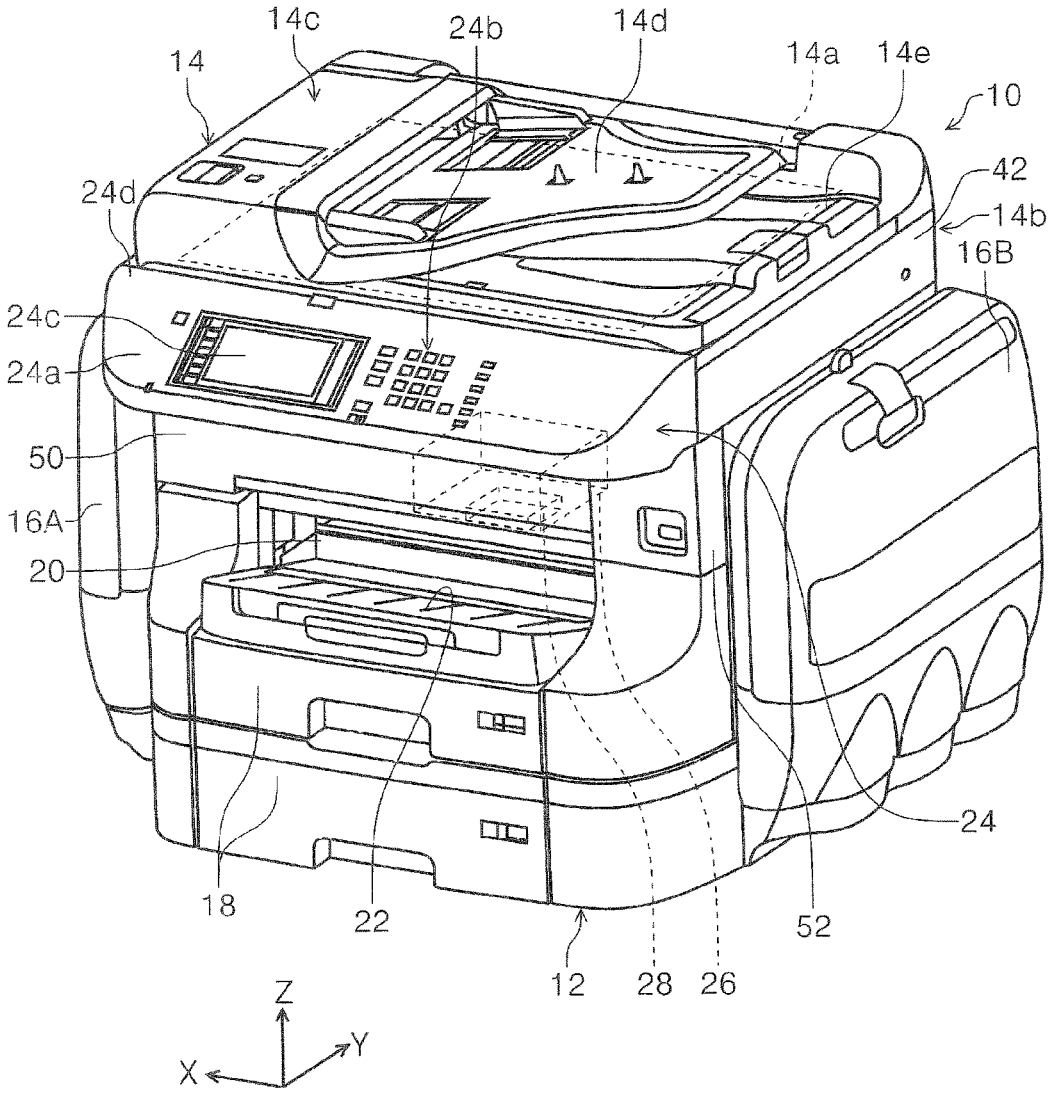
FIG. 1 is an external perspective view of a printer according to the invention.

Hereinafter, embodiments of the invention will be described with reference to the drawings: In each embodiment, the same components are denoted by the same reference numerals and are described only in the first embodiment, and descriptions of these components are omitted in the following embodiments.

Figure 2:
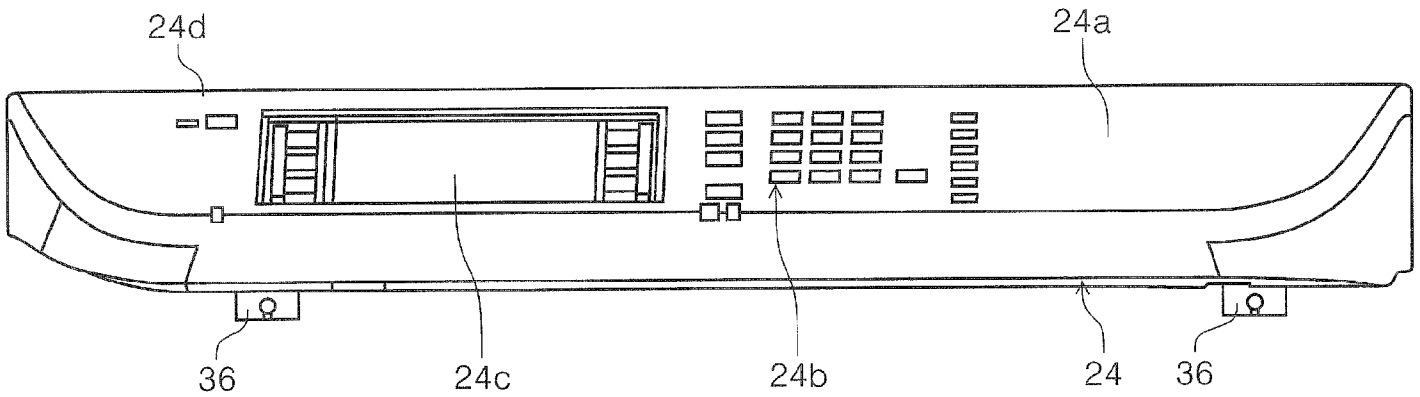
FIG. 2 is a front view of an operation unit according to the invention.
Figure 3:
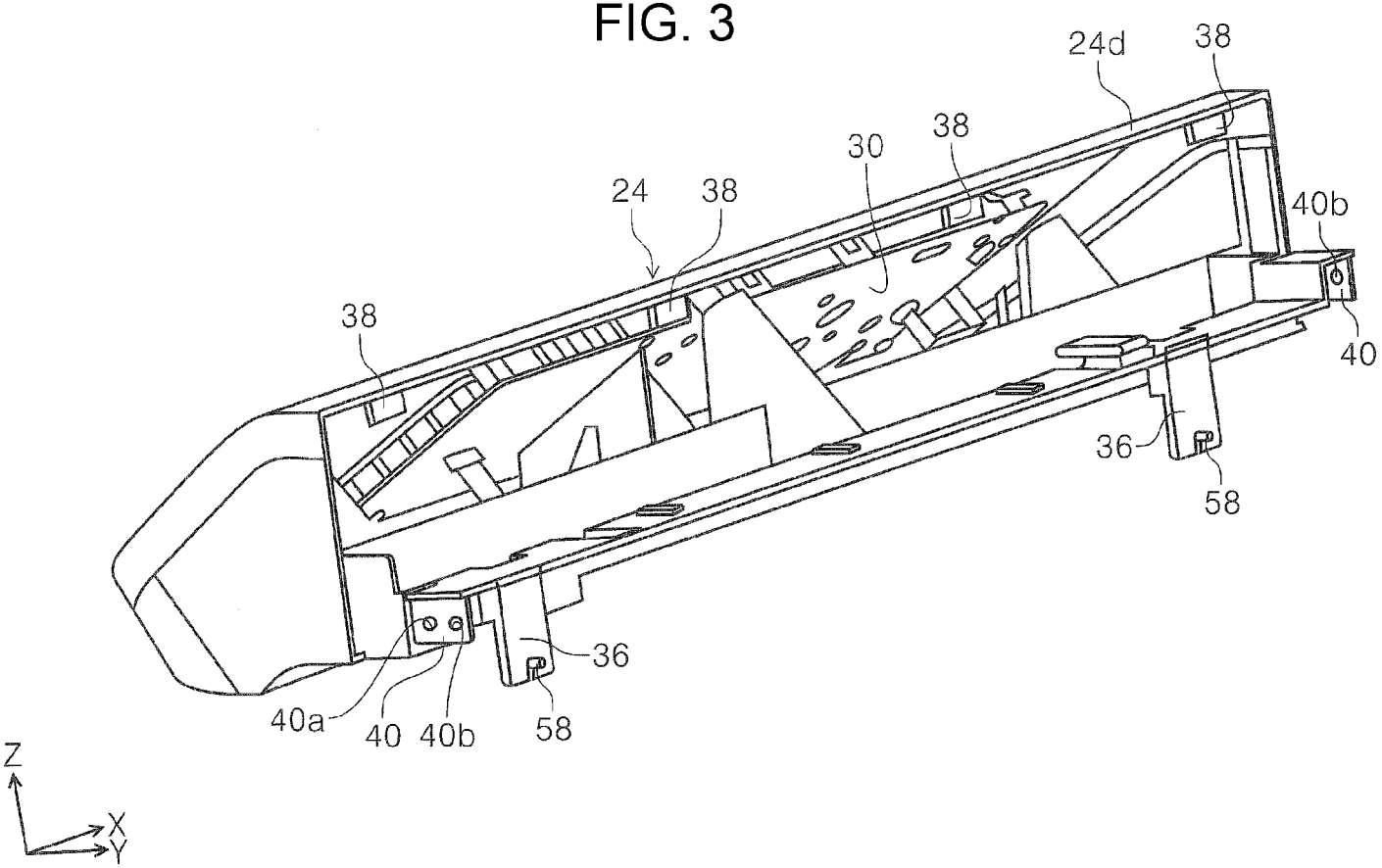
FIG. 3 is a perspective view of the operation unit according to the invention as seen from the rear.
Figure 4:
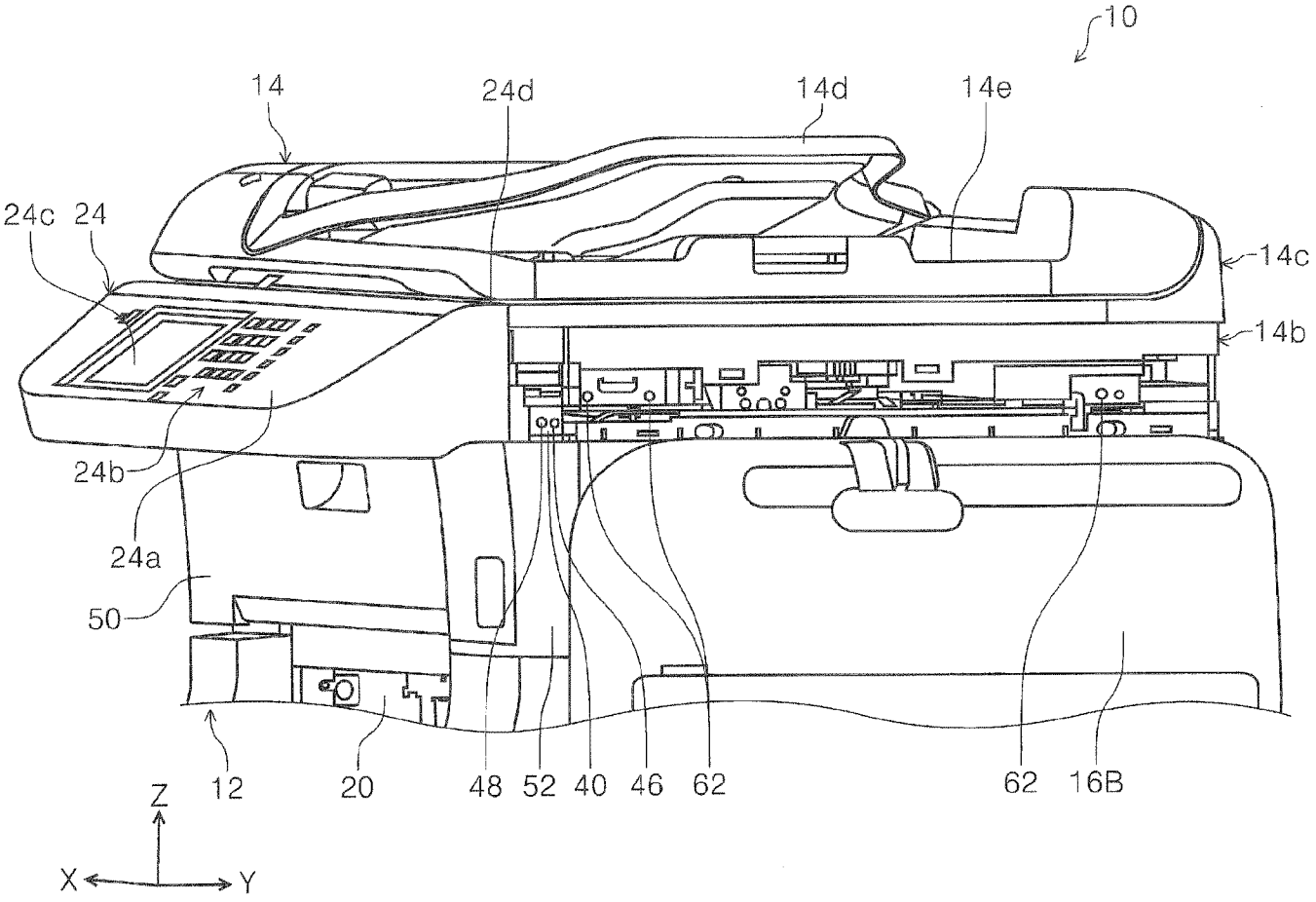
FIG. 4 is a perspective view showing a state in which a cover member is removed from the right side surface of the printer.
Figure 5:
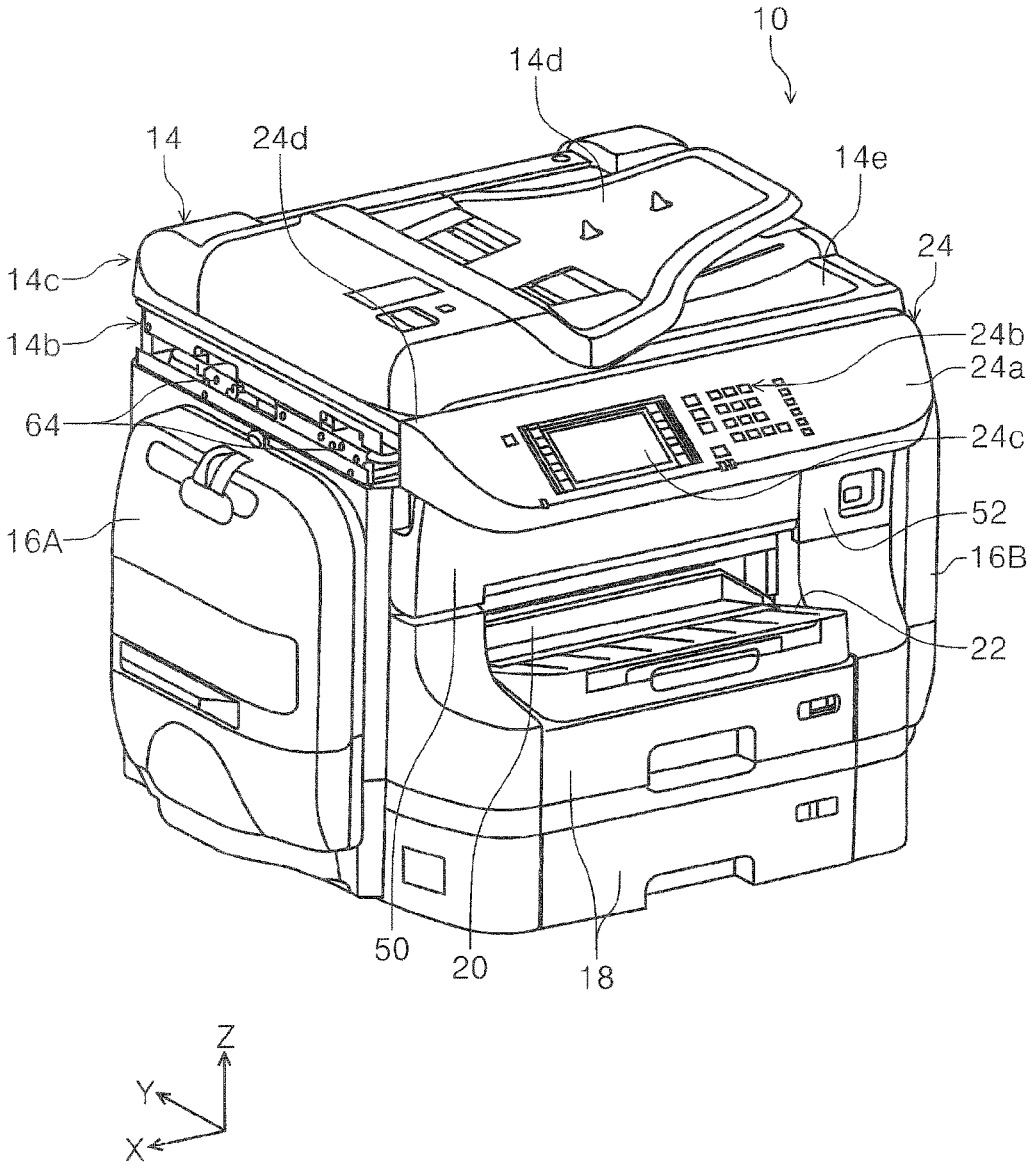
FIG. 5 is a perspective view showing a state in which a cover member is removed from the left side surface of the printer.
Figure 6:
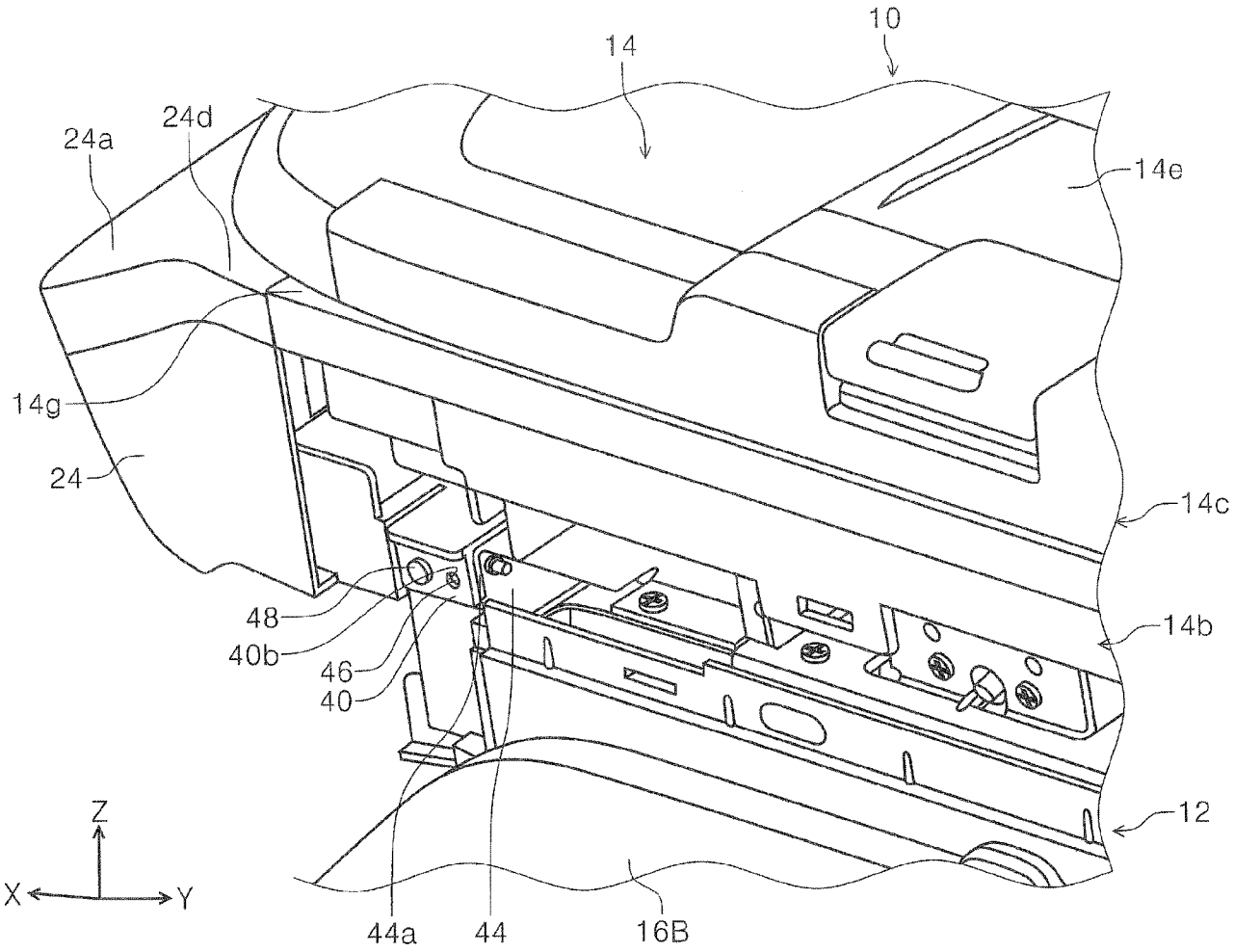
FIG. 6 is a perspective view showing a connection portion with the operation unit on a side surface of a recording mechanism unit.
Figure 7:
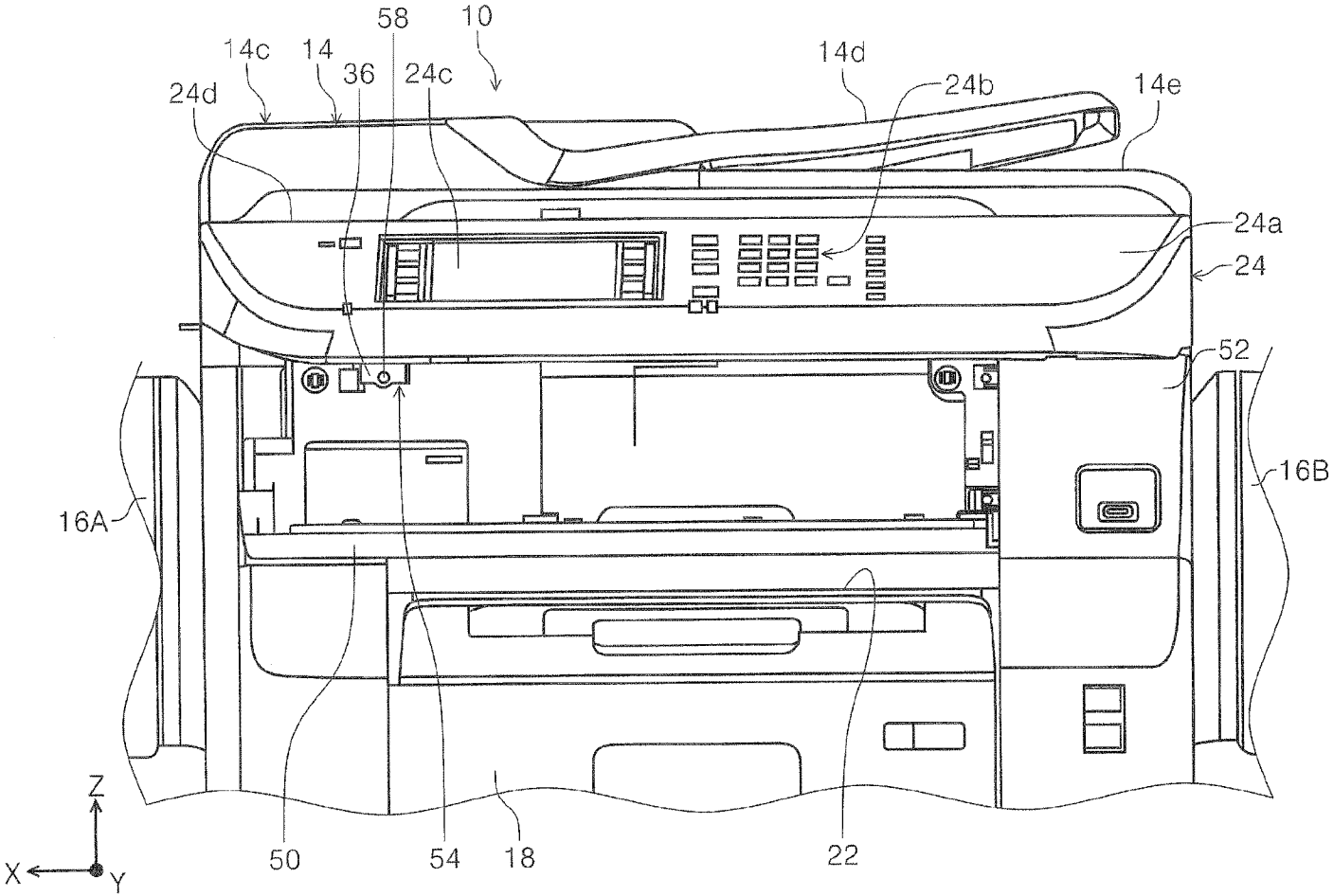
FIG. 7 is a front view showing a state in which a front cover is opened on the front side of the printer.

FIG. 1 is an external perspective view of a printer according to the invention. FIG. 2 is a front view of an operation unit according to the invention. FIG. 3 is a perspective view of the operation unit according to the invention as seen from the rear. FIG. 4 is a perspective view showing a state in which a cover member is removed from the right side surface of the printer. FIG. 5 is a perspective view showing a state in which a cover member is removed from the left side surface of the printer. FIG. 6 is a perspective view showing a connection portion with the operation unit on a side surface of a recording mechanism unit. FIG. 7 is a front view showing a state in which a front cover is opened on the front side of the printer.

Figure 8:
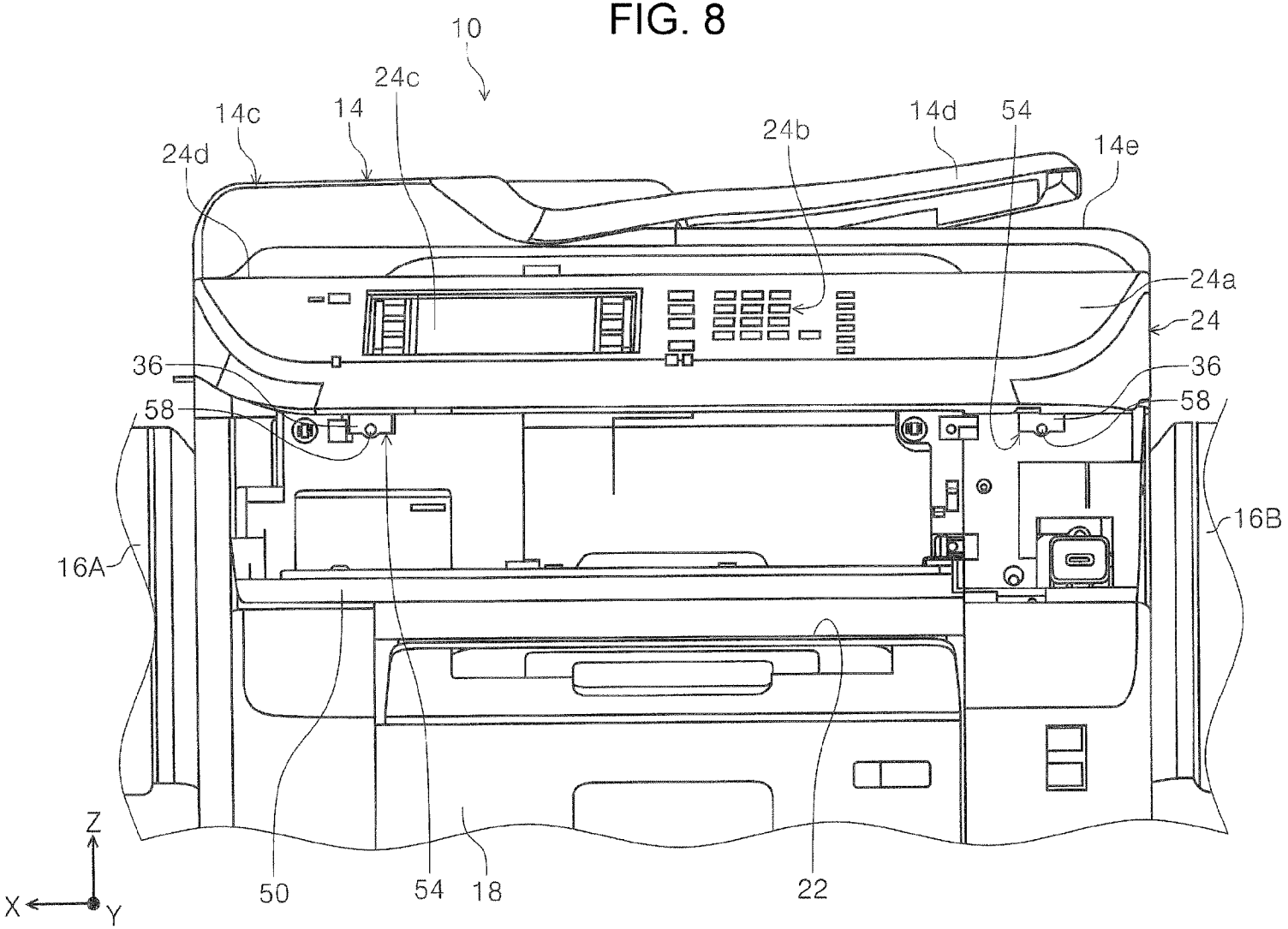
FIG. 8 is a front view showing a state in which a front right cover is removed on the front side of the printer.
Figure 9:
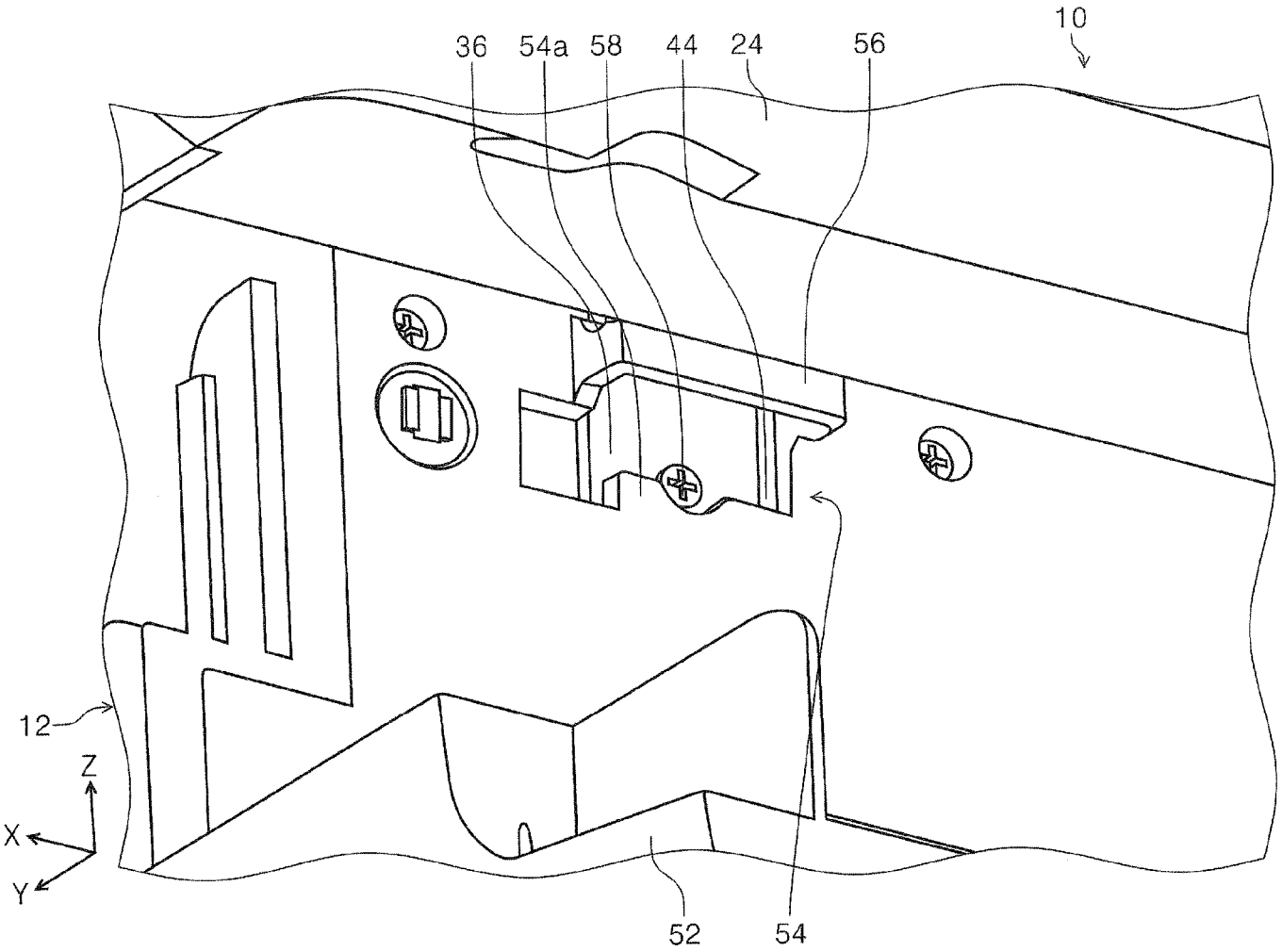
FIG. 9 is a perspective view showing a fixing portion provided at a left end portion of the operation unit in a state in which the operation unit is coupled to the scanner unit on the front side of the printer.
Figure 10:
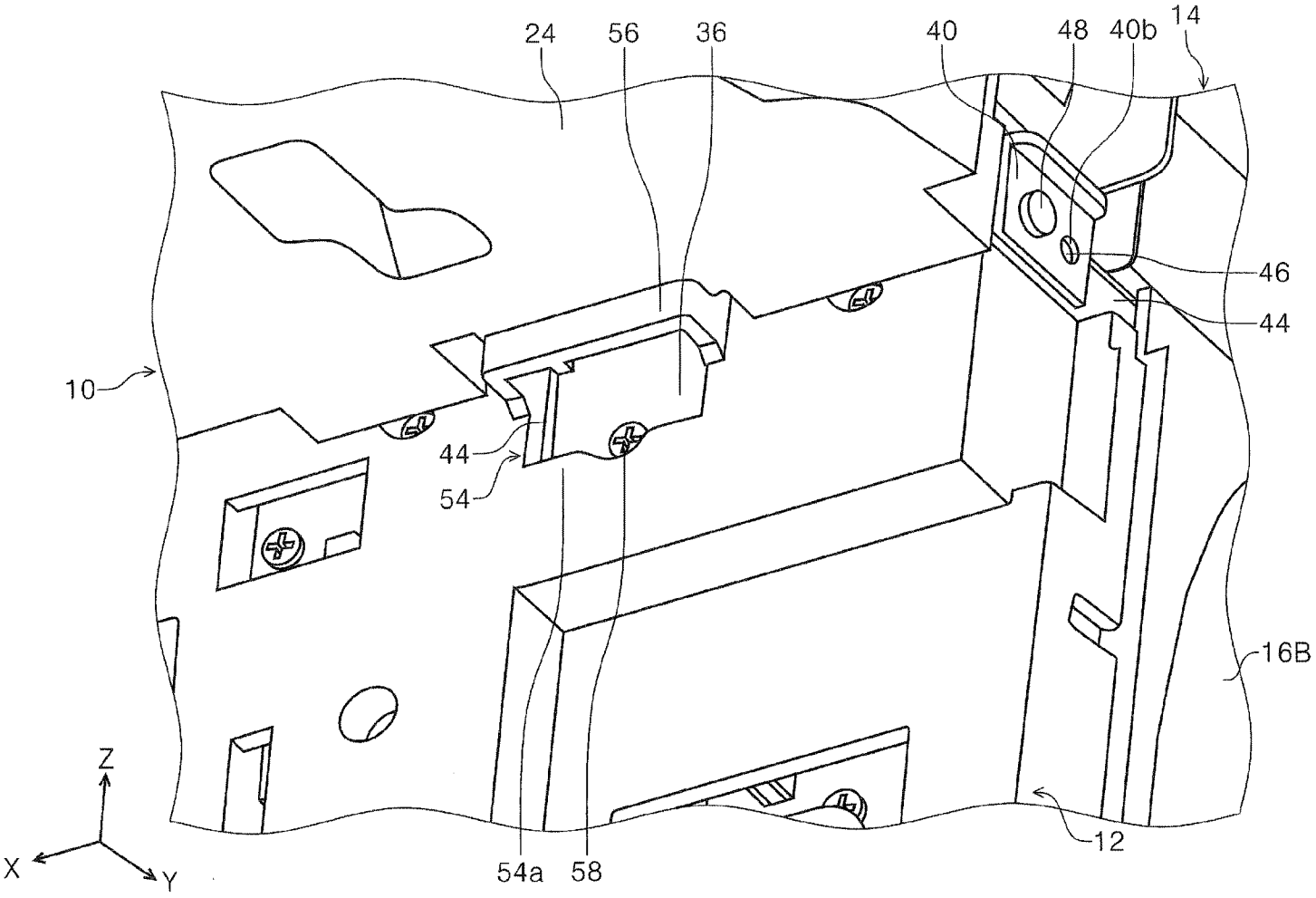
FIG. 10 is a perspective view showing a fixing portion provided at a right end portion of the operation unit in a state in which the operation unit is coupled to the scanner unit on the front side of the printer.
Figure 11:
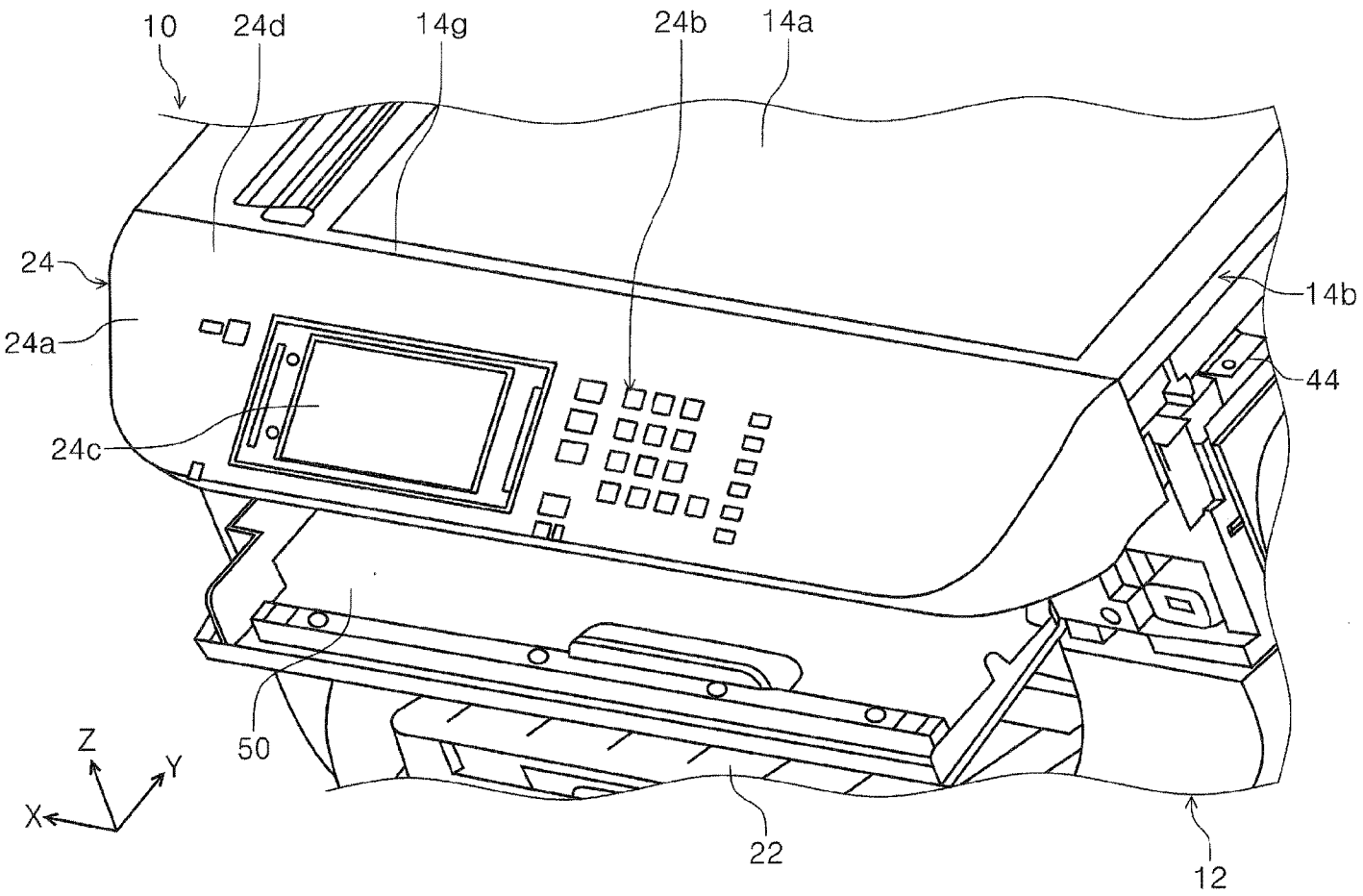
FIG. 11 is a perspective view of a coupling portion between the operation unit and a reading mechanism unit as seen from above when a feed mechanism unit is opened in the scanner unit.

FIG. 8 is a front view showing a state in which a front right cover is removed on the front side of the printer. FIG. 9 is a perspective view showing a fixing portion provided at a left end portion of the operation unit in a state in which the operation unit is coupled to the scanner unit on the front side of the printer. FIG. 10 is a perspective view showing a fixing portion provided at a right end portion of the operation unit in a state in which the operation unit is coupled to the scanner unit on the front side of the printer. FIG. 11 is a perspective view of a coupling portion between the operation unit and a reading mechanism unit as seen from above when a feed mechanism unit is opened in the scanner unit.

Figure 12:
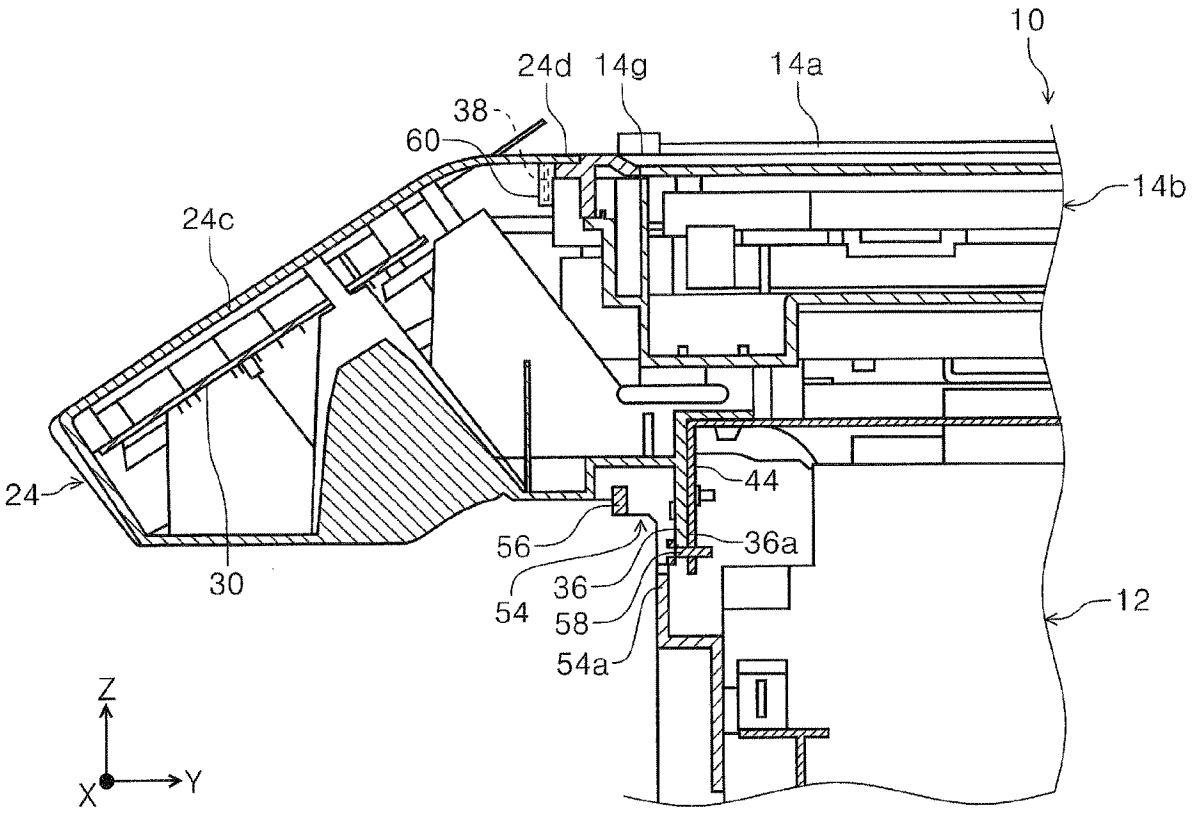
FIG. 12 is a side cross-sectional view showing a state in which the operation unit is coupled to the scanner unit.
Figure 13:
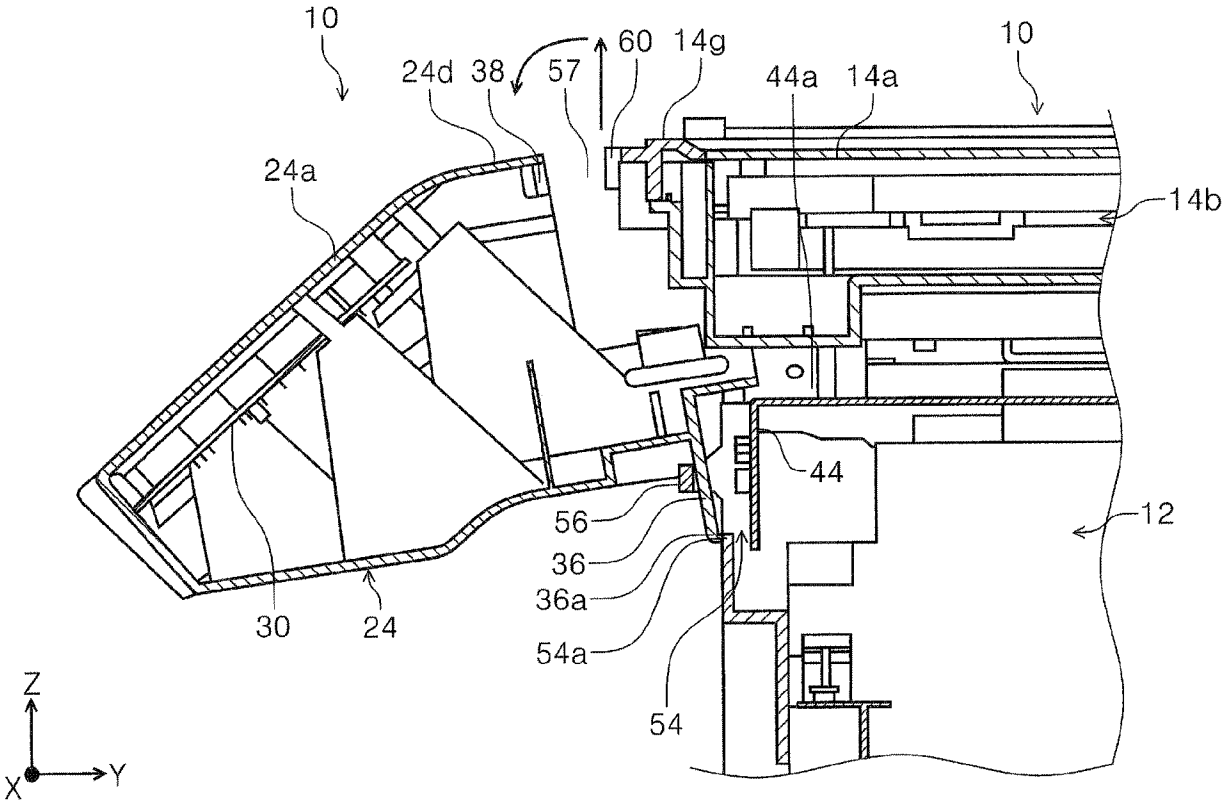
FIG. 13 is a side cross-sectional view showing a state in which the coupling of the operation unit to the scanner unit is released.
Figure 14:
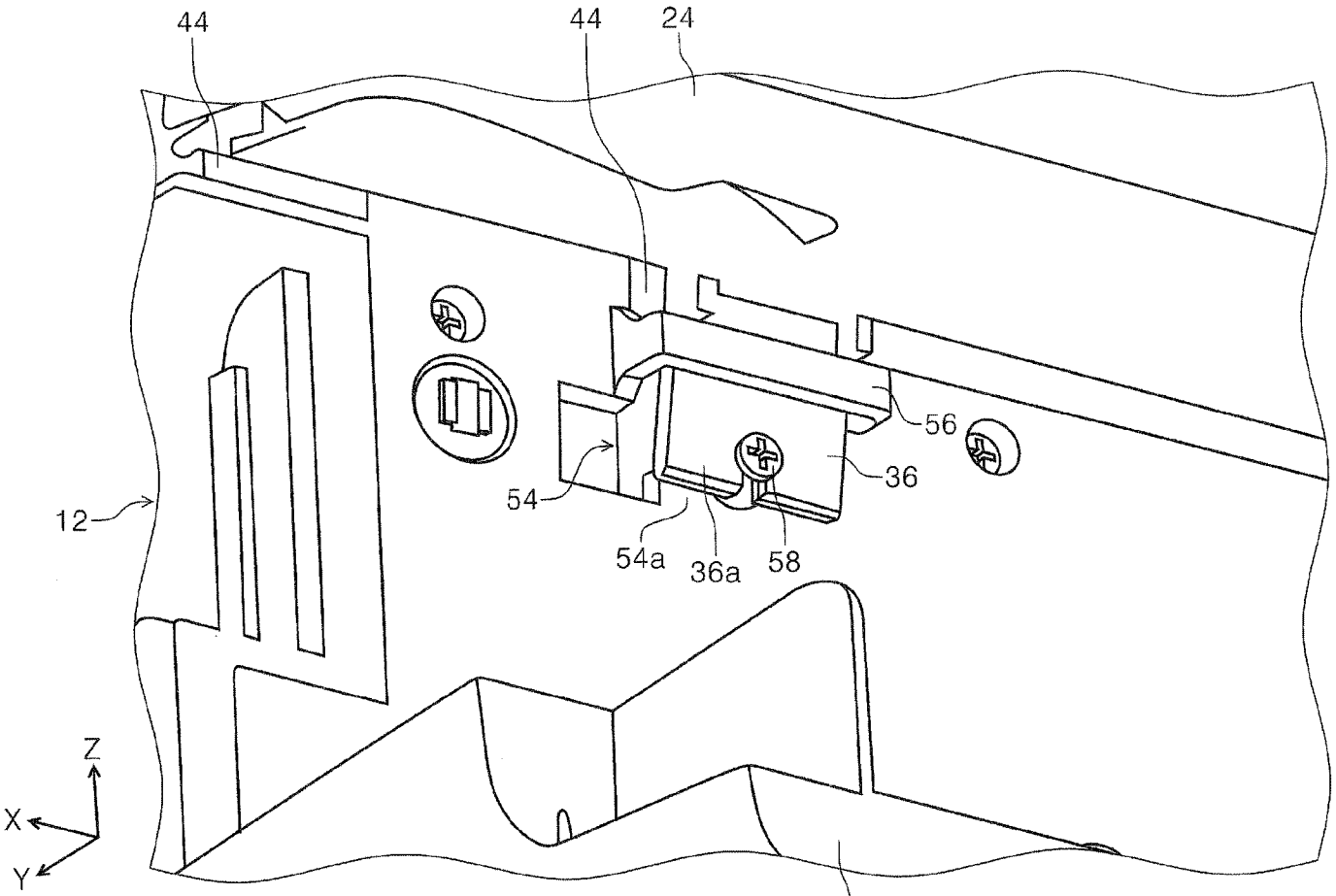
FIG. 14 is a perspective view showing a state in which the fixing portion provided at the left end portion of the operation unit is supported by a support portion of the recording mechanism unit when the coupling of the operation unit to the scanner unit is released.
Figure 15:
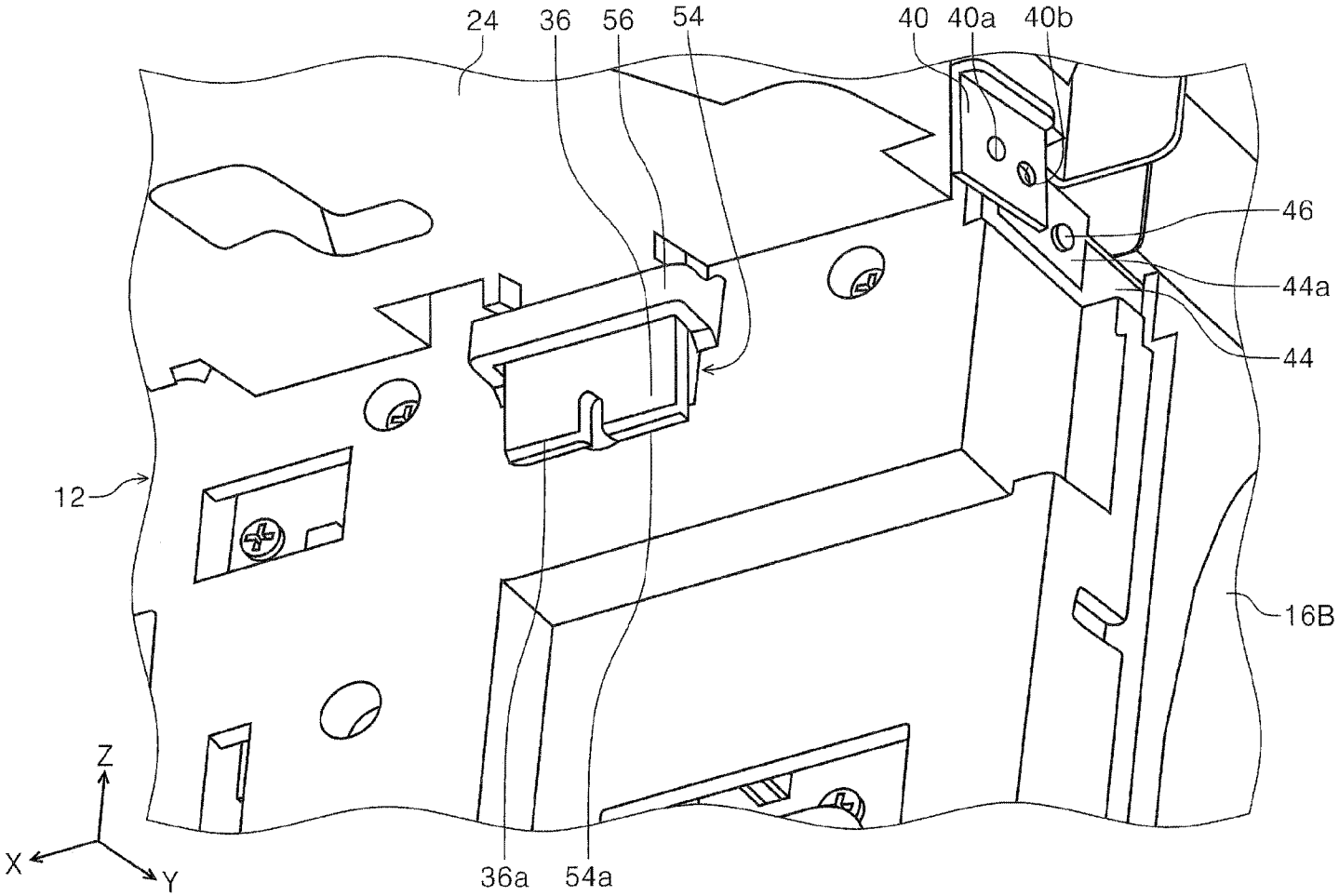
FIG. 15 is a perspective view showing a state in which the fixing portion provided at the right end portion of the operation unit is supported by a support portion of the recording mechanism unit when the coupling of the operation unit to the scanner unit is released.

FIG. 12 is a side cross-sectional view showing a state in which the operation unit is coupled to the scanner unit. FIG. 13 is a side cross-sectional view showing a state in which the coupling of the operation unit to the scanner unit is released. FIG. 14 is a perspective view showing a state in which the fixing portion provided at the left end portion of the operation unit is supported by a support portion of the recording mechanism unit when the coupling of the operation unit to the scanner unit is released. FIG. 15 is a perspective view showing a state in which the fixing portion provided at the right end portion of the operation unit is supported by a support portion of the recording mechanism unit when the coupling of the operation unit to the scanner unit is released.

Figure 16:
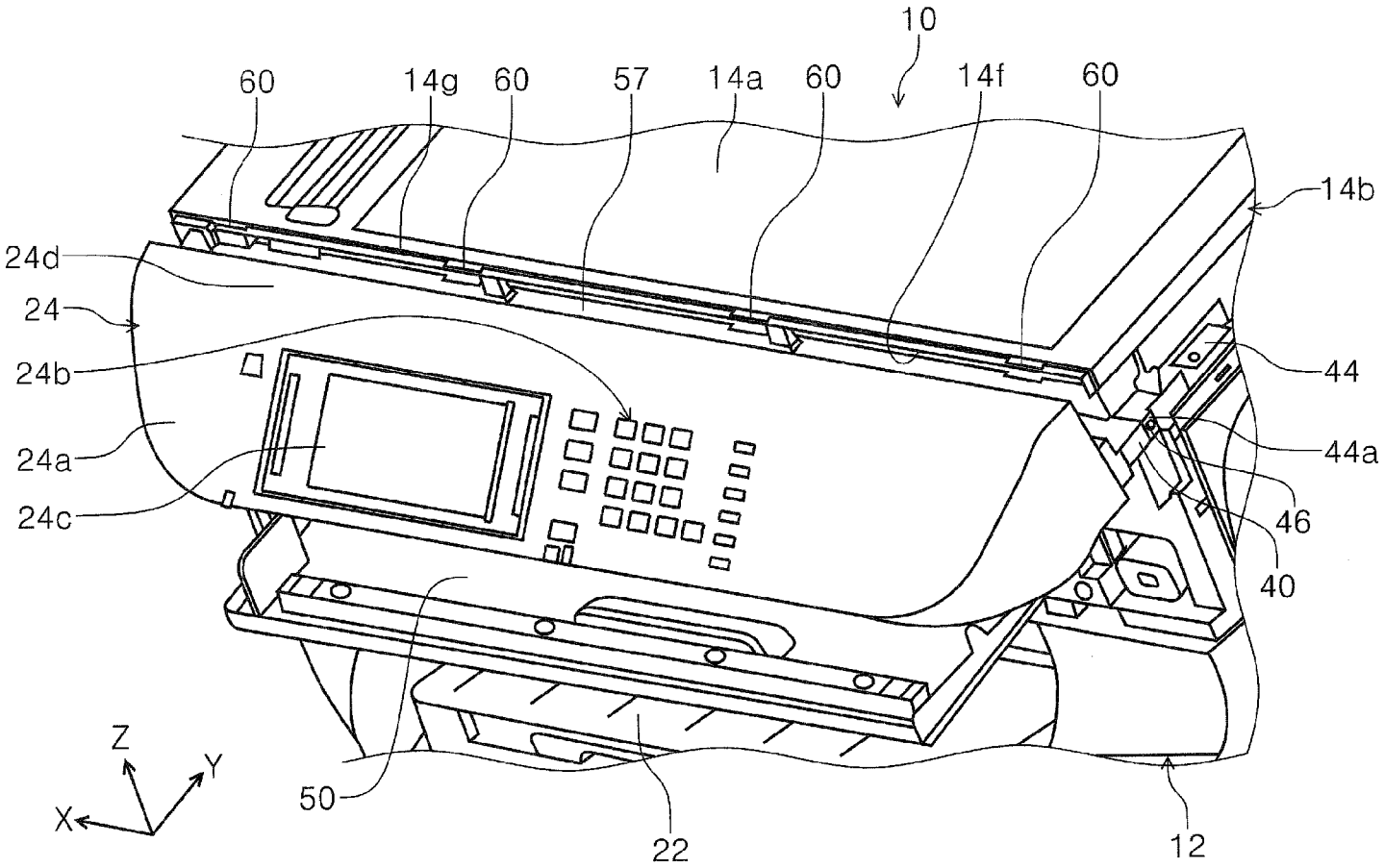
FIG. 16 is a perspective view showing a state in which the coupling of the operation unit to the scanner unit is released and the operation unit is supported by the recording mechanism unit on the front side of the printer.
Figure 17:
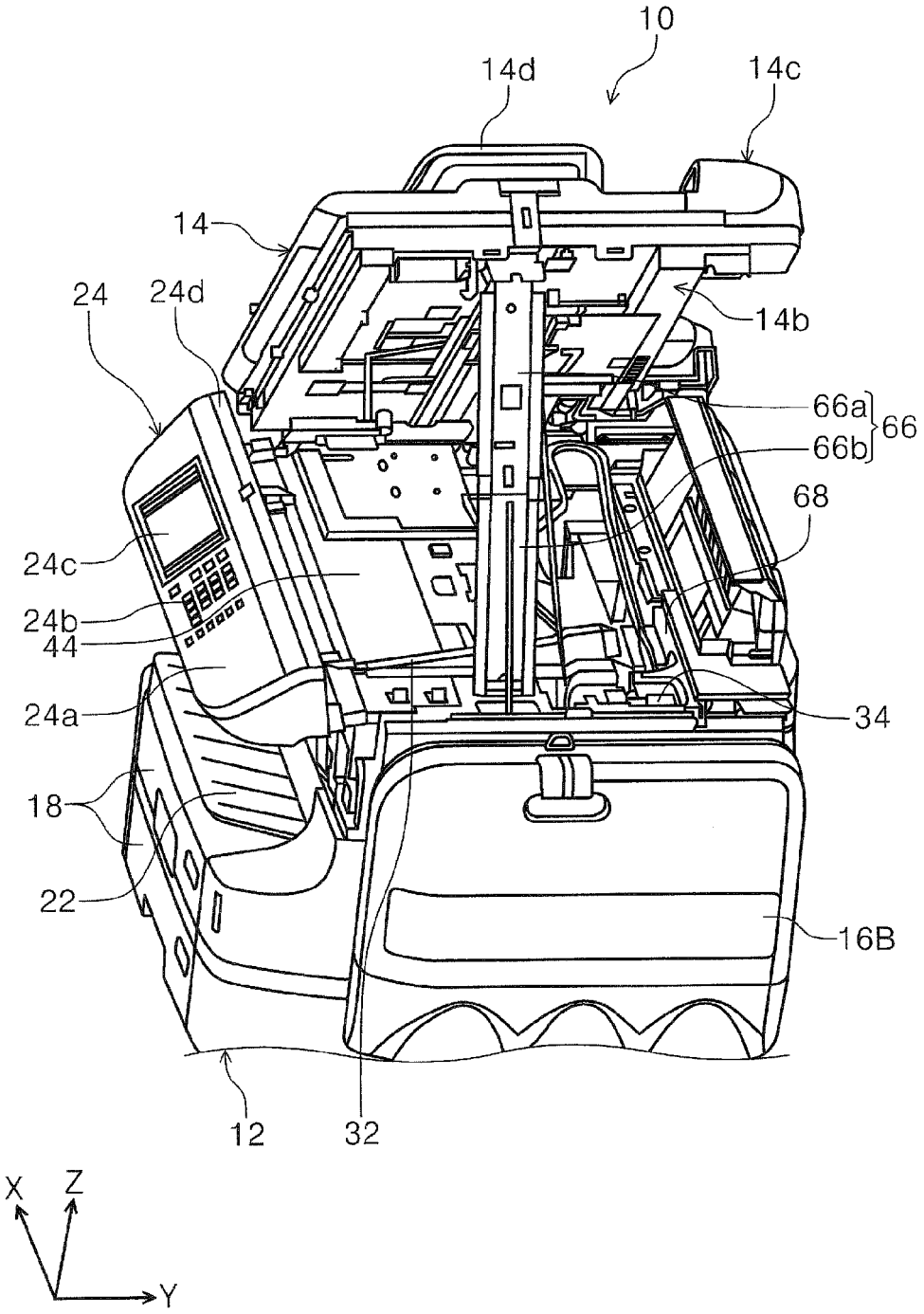
FIG. 17 is a perspective view showing a state in which the scanner unit is rotated in a state in which the operation unit is supported by the recording mechanism unit in the printer.
Figure 18:
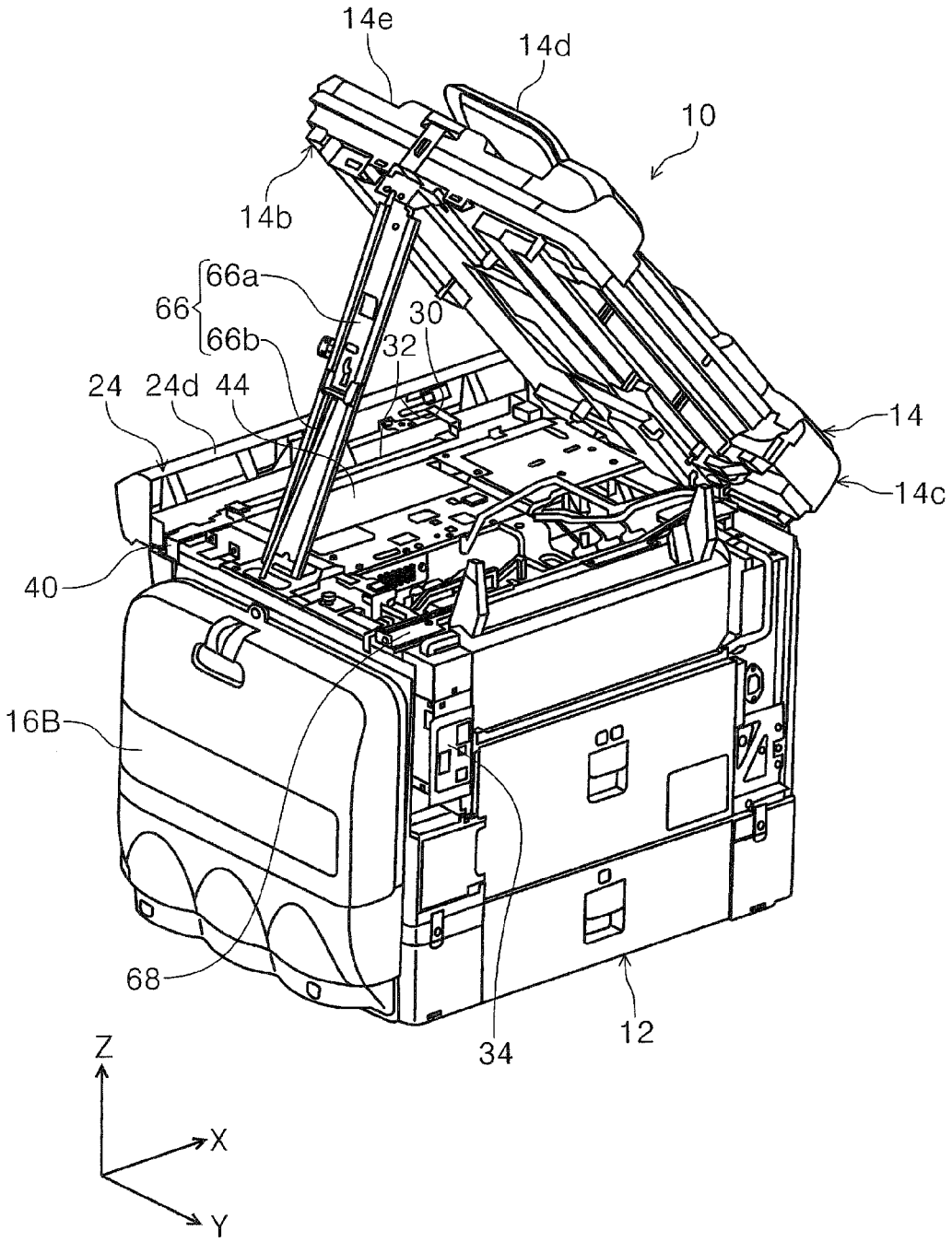
FIG. 18 is a perspective view showing a control unit and a cable connecting the control unit and the operation unit in the printer.
Figure 19:
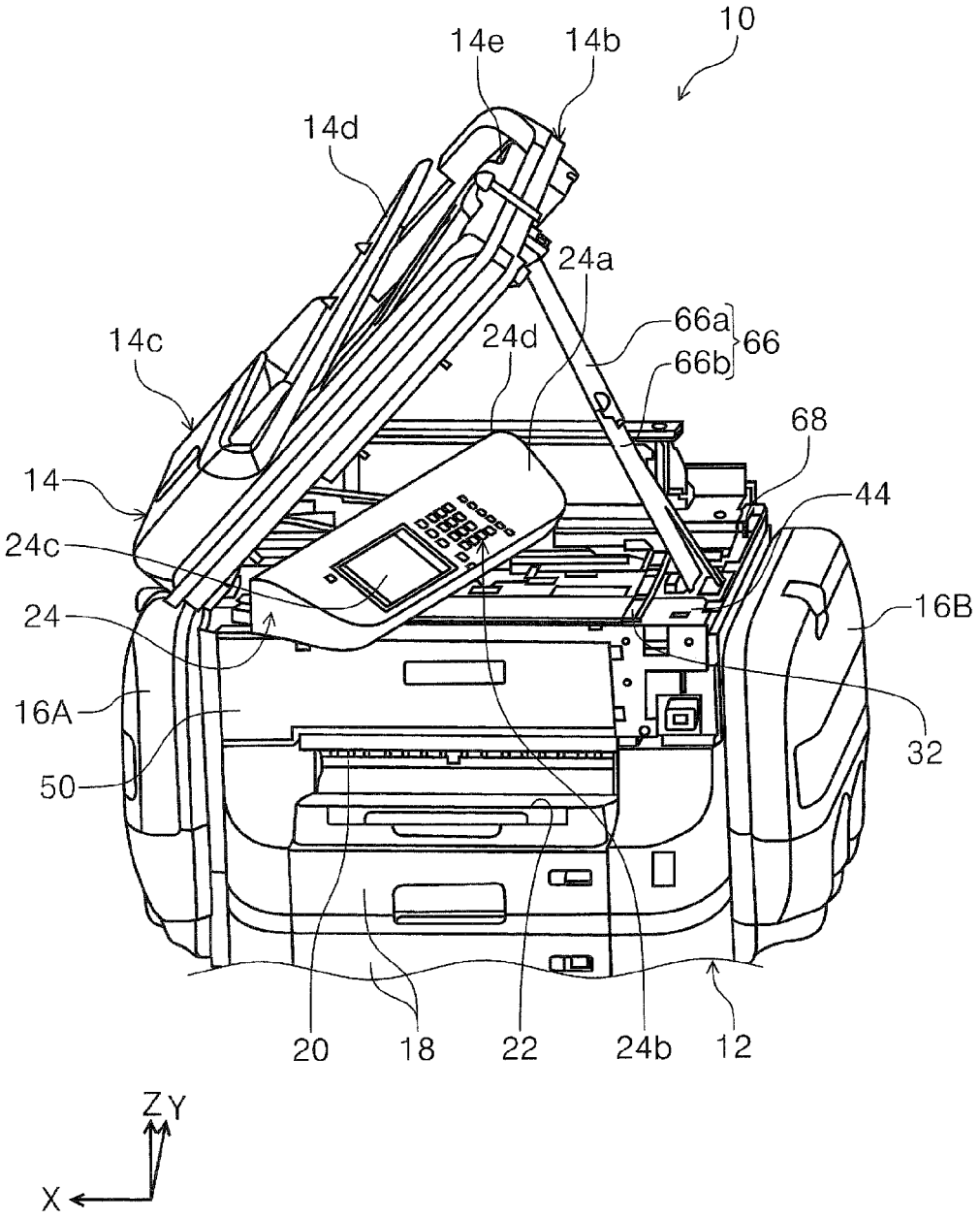
FIG. 19 is a perspective view showing a state in which the operation unit is being moved to the rear side of the recording mechanism unit.
Figure 20:
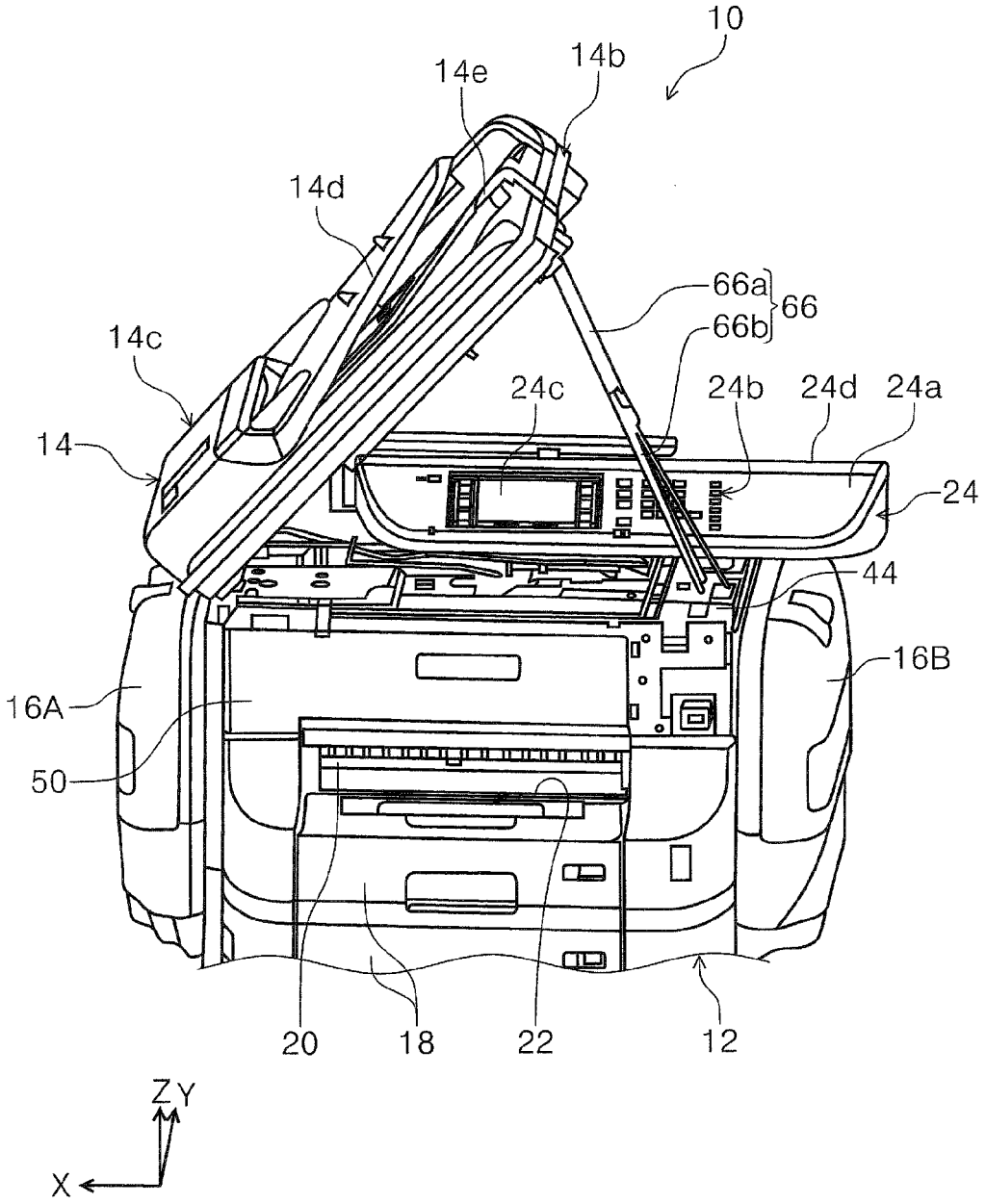
FIG. 20 is a perspective view showing a state in which the operation unit is placed in the rear side of the recording mechanism unit.

FIG. 16 is a perspective view showing a state in which the coupling of the operation unit to the scanner unit is released and the operation unit is supported by the recording mechanism unit on the front side of the printer. FIG. 17 is a perspective view showing a state in which the scanner unit is rotated in a state in which the operation unit is supported by the recording mechanism unit in the printer. FIG. 18 is a perspective view showing a control unit and a cable connecting the control unit and the operation unit in the printer. FIG. 19 is a perspective view showing a state in which the operation unit is being moved to the rear side of the recording mechanism unit. FIG. 20 is a perspective view showing a state in which the operation unit is placed in the rear side of the recording mechanism unit.

In the X-Y-Z coordinate system shown in each drawing, the X direction is a document feeding direction in the feed mechanism unit of the scanner unit and a width direction of the recording apparatus, the Y direction is a main scanning direction in the reading mechanism unit and a depth direction of the recording apparatus, and the Z direction is an apparatus height direction. In each drawing, +X direction is defined as a direction toward the left of the apparatus, −X direction is defined as a direction toward the right of the apparatus, −Y direction is defined as a direction toward the front of the apparatus, +Y direction is defined as a direction toward the rear of the apparatus, +Z direction is defined as a direction toward the above of the apparatus, and the −Z direction is defined as a direction toward the below of the apparatus.

DESCRIPTION OF EMBODIMENTS

Overview of Printer

As shown in FIG. 1, the printer 10, which is the "recording apparatus" according to the embodiment, includes a recording mechanism unit 12 that forms an apparatus main body, a scanner unit 14 which is an "opening/closing unit that is arranged above the recording mechanism unit 12 and can rotate with respect to the recording mechanism unit 12, and ink container storage units 16A and 16B respectively arranged on the right side surface and the left side surface in the apparatus width direction of the recording mechanism unit 12.

A medium containing unit 18 that contains recording media is provided in a lower portion of the recording mechanism unit 12. A discharge port 20 is provided in the front side of the recording mechanism unit 12. A discharge tray 22 that receives a recording medium discharged from the discharge port 20 is provided above the medium containing unit 18.

On the apparatus front side, an operation unit 24 is provided above the discharge port 20. The operation unit 24 will be described later in detail. In the recording mechanism unit 12, a carriage 26 (see a dashed line portion) is provided that can be reciprocally moved along the apparatus width direction by a driving means not shown in the drawings. A recording head 28 (see a dashed line portion), which is a "recording means", that discharges ink toward a recording medium is provided under the carriage 26.

As an example, an ink container (not shown in the drawings) that contains black ink is stored in the ink container storage unit 16A (on the left side in the apparatus width direction) and a plurality of ink containers (not shown in the drawings) corresponding to three color inks of magenta, yellow, and cyan, respectively, are stored in the ink container storage unit 16B (on the right side in the apparatus width direction). In the embodiment, ink can be supplied to the recording head 28 from each ink container.

In the embodiment, a recording medium contained in the medium containing unit 18 is sent to an area facing the recording head 28 of the carriage 26 by a feeding means not shown in the drawings. Then, the recording medium receives ink discharged from the recording head 28 in the area facing the recording head 28, so that recording is performed. Then, the recording medium on which the recording is preformed is discharged to the discharge tray 22.

Overview of Scanner Unit

Next, an overview of the scanner unit 14 will be described. The scanner unit 14 includes a reading mechanism unit 14*b* including a document table 14*a* (see FIG. 11) on an upper surface of which a document is mounted and a feed mechanism unit 14*c* that can switch between a closed posture and an open posture with respect to the reading mechanism unit 14*b*. In the embodiment, the feed mechanism unit 14*c* is formed to be able to rotate with respect to the reading mechanism unit 14*b* around an end portion on the rear side of the apparatus as a rotating fulcrum.

It is possible to set a document on the document table 14*a* by causing the feed mechanism unit 14*c* to have a posture open to the reading mechanism unit 14*b*. In the reading mechanism unit 14*b*, a reading means (not shown in the drawings) is provided that can read a surface to be read of the document set on the document table 14*a*. The feed mechanism unit 14*c* is formed to be able to transport the document set on a document setting portion 14*d* toward a document discharge tray 14*e* and is formed to be able to read the surface to be read of the document by the reading means while transporting the document.

About Operation Unit

Hereinafter, a configuration of the operation unit 24 will be described with reference to FIGS. 2 and 3. As shown in FIGS. 2 and 3, the operation unit 24 extends in the apparatus width direction. As shown in FIG. 1, an operation surface 24*a* is provided on the front side in the apparatus depth direction of the operation unit 24. In the embodiment, the operation surface 24*a* is formed as an inclined surface inclining forward in the apparatus depth direction and downward in the apparatus height direction. In the embodiment, as shown in FIG. 2, the operation surface 24*a* is provided with an input unit 24*b* including a plurality of input buttons and switches and a display unit 24*c* such as a liquid crystal panel.

As shown in FIG. 3, in the operation unit 24, a circuit substrate 30 is provided which includes a plurality of electronic circuits, switches that receive operation input from the input unit 24*b*, and a liquid crystal panel for displaying information on the display unit 24*c*. As shown in FIGS. 17 and 18, one end of a cable 32 is connected to the circuit substrate 30. In the embodiment, the cable 32 is formed as a flexible cable such as an FFC (flexible flat cable).

The other end of the cable 32 is connected to a control unit 34 shown in FIG. 18. In the embodiment, the control unit 34 is provided on the rear side in the apparatus depth direction and at a left end portion in the apparatus width direction in the recording mechanism unit 12. The control unit 34 is configured as a circuit substrate including a plurality of electronic components in the embodiment. The cable 32 extends from the circuit substrate 30 in the rear side of the operation unit 24, extends rightward in the apparatus width direction in the rear side end portion of the operation unit 24, then, extends toward the rear side in the apparatus depth direction in an upper portion of the recording mechanism unit 12, and is connected to the control unit 34.

As shown in FIGS. 2 and 3, first fixing portions 36 and 36 formed as protrusion portions that protrude downward are provided under a rear side end portion of the operation unit 24 (at a portion facing the scanner unit 14 in the apparatus depth direction). In the embodiment, two first fixing portions 36 and 36 are provided apart from each other in the apparatus width direction.

A plurality of coupling portions 38, 38, 38, and 38 protruding downward in the apparatus height direction are provided in an upper portion of the rear side end portion of the operation unit 24. In the embodiment, four coupling portions 38, 38, 38, and 38 are provided appropriately apart from each other in the apparatus width direction.

As shown in FIG. 3, second fixing portions 40 and 40 are respectively provided at both ends in the apparatus width direction of the operation unit 24. A through hole 40*a* and a lock hole 40*b* are provided to the second fixing portion 40.

About Coupling of Operation Unit

Next, coupling of the operation unit with the recording mechanism unit 12 and the scanner unit 14 will be described with reference to FIGS. 4 to 18. In the description below, while the configuration of the coupling of the operation unit with the recording mechanism unit 12 and the scanner unit 14 will be described, a transition from a coupling state of the operation unit 24 to a coupling-released state will be described.

As shown in FIG. 1, cover members 42 and 42 are attached to both ends of the reading mechanism unit 14*b* of the scanner unit 14 in the apparatus width direction. When the cover members 42 are removed from both ends of the reading mechanism unit 14*b*, a connection portion between the recording mechanism unit 12 and the scanner unit 14 is exposed as shown in FIGS. 4 to 6. Further, as shown in FIGS. 4 to 6, the second fixing portion 40 of the operation unit 24 fixed to the recording mechanism unit 12 is also exposed. Although not shown in FIG. 5, the second fixing portion 40 provided in the left portion of the operation unit 24 is also exposed in the same manner as the second fixing portion 40 provided in the right portion of the operation unit 24.

A coupling between the second fixing portion 40 and the recording mechanism unit 12 will be described with reference to FIG. 6. A frame member 44 is provided on the apparatus front side of the recording mechanism unit 12 (see FIGS. 12, 13, and 17). In the embodiment, the frame member 44 is formed by bending a metal plate by a bending work or the like. A to-be-fixed portion 44*a* is provided at both ends of the frame member 44 in the apparatus width direction. A positioning dowel 46 protruding toward outside of the apparatus in the apparatus width direction is provided in the to-be-fixed portion 44*a* (see FIG. 15). The positioning dowel 46 is inserted into and engaged with a lock hole 40*b* of the second fixing portion 40. In the embodiment, the positioning dowel 46 and the lock hole 40*b* are configured as a snap-fit.

A screw hole not shown in the drawings is provided in the to-be-fixed portion 44*a*. The second fixing portion 40 and the to-be-fixed portion 44*a* are connected by tightening a second fixing portion attaching screw 48 into the screw hole not shown in the drawings through the through hole 40*a*.

Here, when loosening the second fixing portion attaching screw 48 that connects the second fixing portion 40 and the to-be-fixed portion 44*a* and then drawing out the positioning dowel 46 from the lock hole 40*b*, the engagement between the positioning dowel 46 and the lock hole 40*b* is released. Thereby, the connected state between the second fixing portion 40 and the to-be-fixed portion 44*a* is released.

Next, as shown in FIG. 1, a front cover 50 and a front right cover 52 are provided under the operation unit 24 on the apparatus front side of the recording mechanism unit 12. In the embodiment, the front cover 50 is rotatably attached to the recording mechanism unit 12 and can have a closed posture with respect to the recording mechanism unit 12 (see FIG. 1) and an open posture with respect to the recording mechanism unit 12 (see FIG. 7). When the front cover 50 is opened, the first fixing portion 36 on the left side in the apparatus width direction of the operation unit 24 is exposed.

When the front cover 50 has the open posture with respect to the recording mechanism unit 12, it is possible to remove the front right cover 52 from the front side of the recording mechanism unit 12 (see FIG. 8). Thereby, the first fixing portion 36 on the right side in the apparatus width direction of the operation unit 24 is exposed.

As shown in FIGS. 9 and 10, support portions 54 and 54 are provided, which are examples of "support means" that support the first fixing portions 36 and 36 of the operation unit 24, on the front side of the recording mechanism unit 12. The support portion 54 opens upward in the apparatus height direction and frontward in the apparatus depth direction. The frame member 44 is arranged on the rear side of the support portion 54 and forms a part of the support portion 54 (see FIG. 12). A frame-shaped hook portion 56 that protrudes frontward in the apparatus depth direction from the support portion 54 is provided on the front side of the support portion 54.

In the embodiment, the first fixing portions 36 and 36 of the operation unit 24 are inserted into the support portions 54 and 54, respectively, from the above and are attached to the frame member 44 by the first fixing portion attaching screws 58 and 58 (see FIG. 12).

In the embodiment, the operation unit 24 is attached to the recording mechanism unit 12 by fixing the first fixing portion 36 to the support portion 54 and fixing the second fixing portion 40 to the to-be-fixed portion 44*a*. Next, a relationship between the operation unit 24 and the scanner unit 14 will be described. As shown in FIG. 16, recess-shaped to-be-coupled portions 60, 60, 60, and 60 that open upward in the apparatus height direction are provided on a circumferential edge 14*f* on the front side in the apparatus depth direction of the reading mechanism unit 14*b* of the scanner unit 14.

The coupling portion 38 of the operation unit 24 is inserted into and engaged with the to-be-coupled portion 60 of the scanner unit 14 from the above in the apparatus height direction (see a dashed line portion in FIG. 12). FIGS. 11 and 12 show a coupling state between the operation unit 24 and the reading mechanism unit 14*b* of the scanner unit 14. In the embodiment, the operation unit 24 is arranged so as to face the circumferential edge 14*f* on the front side in the apparatus depth direction of the reading mechanism unit 14*b*. On the circumferential edge 14*f* on the front side in the apparatus depth direction of the reading mechanism unit 14*b*, an upper surface 14*g* of the reading mechanism unit 14*b* and an upper surface 24*d* of the operation unit 24 are formed to be flush with each other. That is to say, a coupling portion between the reading mechanism unit 14*b* and the operation unit 24 are formed to be low profile in appearance (see also FIG. 11).

Hereinafter, a procedure to release the coupling between the operation unit 24 and the scanner unit 14 and a procedure to open the scanner unit 14 with respect to the recording mechanism unit 12 will be described. First, the feed mechanism unit 14*c* of the scanner unit 14 is rotated to the rear side in the apparatus depth direction with respect to the reading mechanism unit 14*b* and the document table 14*a* is exposed (see FIG. 11). Then, the fixing between the operation unit 24 and the recording mechanism unit 12 is released, that is, the connection between the first fixing portion 36 and the support portion 54 and the connection between the second fixing portion 40 and the to-be-fixed portion 44*a* are released. Next, when the operation unit 24 is raised upward in the apparatus height direction with respect to the recording mechanism unit 12 and the reading mechanism unit 14*b* of the scanner unit 14 as indicated by an arrow shown in FIG. 13, the engaging state between the coupling portion 38 of the operation unit 24 and the to-be-coupled portion 60 of the reading mechanism unit 14*b* is released.

Then, the operation unit 24 that is raised with respect to the recording mechanism unit 12 and the reading mechanism unit 14*b* is inclined to the front side in the apparatus depth direction and is lowered downward without change, so that, as shown in FIGS. 13 to 15, a lower end portion 36*a* of the first fixing portion 36 comes into contact with an end portion 54*a* of the support portion 54. Then, the first fixing portion 36 becomes a state in which the first fixing portion 36 is supported by the hook portion 56 in a posture in which the first fixing portion 36 is inclined to the front side in the apparatus depth direction and a state in which first fixing portion 36 is hooked by the hook portion 56. In other words, the operation unit 24 becomes a state in which the operation unit 24 is temporarily placed with respect to the recording mechanism unit 12 in a posture in which the operation unit 24 is inclined to the front side in the apparatus depth direction (see FIG. 16). In the state in which the operation unit 24 is temporarily placed, that is, in a state in which the coupling is released, a distance between the rear side end portion of the operation unit 24 and the circumferential edge 14*f* of the reading mechanism unit 14*b* is greater than that in the coupling state, so that a gap 57 (see FIGS. 13 and 16) is formed.

Here, as shown in FIGS. 4 and 5, the reading mechanism unit 14*b* of the scanner unit 14 is attached to the recording mechanism unit 12 by a plurality of scanner attaching screws 62, 62, and 62 on the right side surface in the apparatus width direction. On the other hand, the reading mechanism unit 14*b* of the scanner unit 14 is attached to the recording mechanism unit 12 through hinge portions 64 and 64 on the left side surface in the apparatus width direction.

Then, in a state in which the operation unit 24 is temporarily placed on the recording mechanism unit 12 (see FIG. 16), the feed mechanism unit 14*c* that has a posture open with respect to the reading mechanism unit 14*b* is caused to have a closed posture by rotating the feed mechanism unit 14*c* toward the reading mechanism unit 14*b*. Then, the scanner attaching screw 62 that connects the recording mechanism unit 12 and the reading mechanism unit 14*b* is loosened and removed. Then, the scanner unit 14 is rotated upward in the apparatus height direction around the hinge portion 64 used as a rotating fulcrum (see FIGS. 17 and 18).

A link portion 66 whose one end is connected to the reading mechanism unit 14*b* and whose other end is connected to the recording mechanism unit 12 is provided between the recording mechanism unit 12 and the reading mechanism unit 14*b* in the apparatus height direction. The link portion 66 includes a first link 66*a* and a second link 66*b*. In the embodiment, the first link 66*a* and the second link 66*b* are connected so as to be able to relatively rotate with respect to each other. In a state in which the scanner unit 14 is closed with respect to the recording mechanism unit 12 (see FIG. 1), the first link 66*a* and the second link 66*b* rotate so as to overlap with each other and become a state in which the first link 66*a* and the second link 66*b* are folded (not shown in the drawings).

When the scanner unit 14 is rotated with respect to the recording mechanism unit 12, the first link 66*a* and the second link 66*b* are relatively displaced from a folded state and switched to a state in which the link portion 66 is opened, that is, a state in which the first link 66*a* and the second link 66*b* form a straight line (see FIGS. 17 and 18). When the scanner unit 14 is rotated by a predetermined angle with respect to the recording mechanism unit 12, the link portion 66 is locked by a lock means provided to the link portion 66 and the link portion 66 supports the scanner unit 14 in a posture in which the scanner unit 14 opens by a predetermined angle with respect to the recording mechanism unit 12. Thereby, it is possible to access the inside of the recording mechanism unit 12 from above the recording mechanism unit 12, so that maintainability of the recording mechanism unit 12 is improved.

In this state, the operation unit 24 that is temporarily placed with respect to the recording mechanism unit 12 is inclined to the front side in the apparatus depth direction as shown in FIG. 17. In other words, the operation unit 24 is inclined in the same direction as an inclination direction of the operation surface 24*a* in a state in which the operation unit 24 is coupled to the scanner unit 14. Further, even when the operation unit 24 is temporarily placed, the circuit substrate 30 and the control unit 34 in the operation unit 24 are connected by the cable 32, so that it is possible to operate the operation unit 24 in the same manner as when the operation unit 24 is coupled to the scanner unit 14.

Next, another embodiment in which the operation unit 24 is temporarily placed will be described with reference to FIGS. 19 and 20. In particular, the embodiment is preferred when a maintenance operation of the recording mechanism unit 12 is performed from the front side of the recording mechanism unit 12.

In FIG. 17, the operation unit 24 that is temporarily placed in the front side of the recording mechanism unit 12 is raised and the hooked state in which first fixing portions 36 and 36 are hooked by the hook portion 56 is released. Then, in a state in which the scanner unit 14 is rotated with respect to the recording mechanism unit 12 as shown in FIG. 19, the operation unit 24 is moved to the rear side in the apparatus depth direction through an area surrounded by the recording mechanism unit 12, the scanner unit 14, and the link portion 66, that is, an area below the link portion 66.

Here, an upper frame member 68, which is an example of a "support means", is extended in the apparatus width direction in the rear side with respect to the frame member 44 in an upper area of the recording mechanism unit 12. As shown in FIG. 20, the operation unit 24 is moved to the rear side with respect to the link portion 66 in the apparatus depth direction in an upper area of the recording mechanism unit 12 and the operation unit 24 is supported by the upper frame member 68. Thereby, the operation unit 24 is temporarily placed in an area above the recording mechanism unit 12. The operation unit 24 that has been temporarily placed on the front side of the recording mechanism unit 12 is moved to the rear side in the apparatus depth direction, so that it is possible to access the recording mechanism unit 12 from the front side in the apparatus depth direction.

Modified Examples of Embodiment (1) In the embodiment, the operation unit 24 is configured to be coupled with the scanner unit 14. However, instead of this configuration, the scanner unit 14 and the operation unit 24 may be configured to be respectively and independently connected to the recording mechanism unit 12.

(2) In the embodiment, the opening/closing unit is configured as the scanner unit 14. However, instead of this configuration, the opening/closing unit may be configured as a cover portion.

(3) In the embodiment, the scanner unit 14 is configured to rotate with respect to the recording mechanism unit 12 with a right end portion in the apparatus width direction as a free end. However, instead of this configuration, the scanner unit 14 may be configured to rotate with a left end portion in the apparatus width direction as a free end or may be configured to rotate with the front side or the rear side in the apparatus depth direction as a free end.

(4) In the embodiment, it is configured so that the link portion 66 that maintains a state in which the scanner unit 14 is opened and the scanner unit 14 are connected on the right side surface in the apparatus width direction. However, instead of this configuration, it may be configured so that the link portion 66 and the scanner unit 14 are connected on the front side in the apparatus depth direction or on the rear side in the apparatus depth direction.

In summary of the above description, the printer 10 includes the recording mechanism unit 12 including the recording head 28 that performs recording on a recording medium, the scanner unit 14 which is rotatably coupled to the recording mechanism unit 12 over the recording mechanism unit 12 and which opens and closes an upper portion of the recording mechanism unit 12, the operation unit 24 which receives operation of the recording mechanism unit 12 and which is arranged to face the circumferential edge 14*f* of the scanner unit 14 and is provided to be able to have a coupling state in which the operation unit 24 and the scanner unit 14 are coupled together and a released state in which the coupling state between the operation unit 24 and the scanner unit 14 is released, the cable 32 that connects the control unit 34 that controls the recording mechanism unit 12 with the operation unit 24, and the support portion 54 which is provided in the recording mechanism unit 12 and which supports the operation unit 24 that is in the released state and is connected to the control unit 34 by the cable 32 in a state in which a distance between the operation unit 24 and the circumferential edge 14*f* of the scanner unit 14 is greater than that in the coupling state, that is, a state in which the gap 57 is formed.

According to the above configuration, the printer 10 includes the support portion 54 which supports the operation unit 24 that is in the released state and is connected to the control unit 34 by the cable 32 in a state in which a distance between the operation unit 24 and the circumferential edge 14*f* of the scanner unit 14 is greater than that in the coupling state, that is, a state in which the gap 57 is formed, so that in a state in which the operation unit 24 is supported by the support portion 54, it is possible to appropriately open the scanner unit 14 while avoiding interference between the operation unit 24 and the scanner unit 14 when opening the scanner unit 14. In other words, in a state in which the operation unit 24 is coupled to the scanner unit 14, it is possible to reduce or eliminate the gap 57 between the operation unit 24 and the scanner unit 14, so that it is possible to secure good appearance of the apparatus.

Further, when the operation unit 24 is in the released state, it is possible to temporarily support the operation unit 24 by the recording mechanism unit 12 without placing the operation unit 24 at a position away from the recording mechanism unit 12 and it is possible to maintain a state in which the operation unit 24 and the control unit 34 are connected by the cable 32, so that it is possible to operate the recording mechanism unit 12 by the operation unit 24 even when the scanner unit 14 is opened. Because of the above, it is possible to obtain a recording apparatus with higher maintainability.

In the printer 10, the operation surface 24*a* of the operation unit 24 is inclined in the coupling state and, in a state in which the operation unit 24 is supported by the support portion 54, the operation surface 24*a* is inclined in the same direction as that in the coupling state.

According to the above configuration, the operation surface 24*a* of the operation unit 24 is inclined in the coupling state and, in a state in which the operation unit 24 is supported by the support portion 54, the operation surface 24*a* is inclined in the same direction as that in the coupling state, so that the operability of the operation unit 24 does not vary so much between the coupling state and a state in which the operation unit 24 is supported by the support portion 54, and therefore good operability can be maintained.

The operation unit 24 has a first fixing portion 36 that is fixed to the recording mechanism unit 12 in the coupling state and the operation unit 24 is supported by the support unit 54 when the first fixing portion 36 engages with the support portion 54.

According to the above configuration, the operation unit 24 is not only coupled with the scanner unit 14 but also fixed to the recording mechanism unit 12, so that it is possible to more reliably fix the operation unit 24, suppress rattling during operation, and provide good operation feeling.

The first fixing portion 36 is formed as a protrusion portion that protrudes downward in the apparatus on the side of the operation unit 24 that faces the scanner unit 14, that is, the rear side of the operation unit 24, and the support portion 54 includes the hook portion 56 that hooks the first fixing portion 36. According to this configuration, a structure in which the operation unit 24 is supported by the support portion 54 is simplified, so that the support portion 54 can be formed at low cost.

The coupling portion 38 that is coupled with the scanner unit 14 in the operation unit 24 is provided in an upper portion of the operation unit 24 and the first fixing portion 36 is provided in a lower portion of the operation unit 24. According to this configuration, the posture of the scanner unit 14 is further stabilized in a state in which the operation unit 24 is coupled to the scanner unit 14.

The upper frame member 68, which is a support means, is provided below the scanner unit 14 which is in an opened state and above the recording mechanism unit 12. According to this configuration, the upper frame member 68 is provided below the scanner unit 14 which is in an opened state and above the recording mechanism unit 12, so that it generates a preferred state for operating the operation unit 24 while viewing the inside of the recording mechanism unit 12 and therefore it is possible to efficiently perform a maintenance operation.

In the printer 10, the scanner unit 14 includes the reading mechanism unit 14*b* that reads a document and the feed mechanism unit 14*c* that automatically feeds a document to the reading mechanism unit 14*b*.

In the embodiment, the operation unit 24 according to the invention is applied to an ink jet printer which is an example of the recording apparatus. However, the operation unit 24 can be applied to other liquid ejecting apparatuses in general.

Here, the liquid ejecting apparatus is not limited to a recording apparatus such as a printer, a copier, and a facsimile which use an ink-jet type recording head, discharge ink from the recording head, and perform recording on a recording medium, but includes apparatuses that eject liquid corresponding to their use instead of ink from a liquid ejecting head corresponding to the ink-jet type recording head to an ejection target medium corresponding to the recording medium and attach the liquid to the ejection target medium.

Examples of the liquid ejecting head include a coloring material ejection head used to manufacture a color filter of a liquid crystal display and the like, an electrode material (conductive paste) ejection head used to form electrodes of an organic EL display, a surface emitting display (FED), and the like, a bioorganic material ejecting head used to manufacture a biochip, and a sample ejecting head used as a precision pipette, in addition to the recording head.

The invention is not limited to the embodiments described above, but various modifications are possible within the scope of the invention described in the claims. It is needless to say that these modifications are included in the scope of the invention.

What is claimed is:

1. A recording apparatus comprising:

a recording mechanism unit including a recording means that performs recording on a recording medium;

an opening/closing unit that is rotatably coupled to the recording mechanism unit in an upper portion of the recording mechanism unit and rotates to open and close the upper portion of the recording mechanism unit;

an operation unit which receives an operation to the recording mechanism unit and which is arranged to face a circumferential edge of the opening/closing unit and is provided to be able to have a coupling state in which the operation unit and the opening/closing unit are coupled together and a released state in which the coupling state between the operation unit and the opening/closing unit is released, the opening/closing unit being capable of fully opening and closing when the operation unit is in the released state;

a cable that connects a control unit that controls the recording mechanism unit with the operation unit; and a support means which is provided in the recording mechanism unit and which supports the operation unit that is in the released state and is connected to the control unit by the cable in a state in which a distance between the operation unit and the circumferential edge of the opening/closing unit is greater than that in the coupling state.

2. The recording apparatus according to claim 1, wherein an operation surface of the operation unit is inclined in the coupling state, and when the operation unit is in the released state and is supported by the support means, the operation surface is more inclined in the same direction as that in the coupling state than in the coupling state.

3. The recording apparatus according to claim 1, wherein the operation unit has a fixing portion that is fixed to the recording mechanism unit in the coupling state, and the operation unit is supported by the support means when the fixing portion engages with the support means.

4. The recording apparatus according to claim 3, wherein the fixing portion is formed as a protrusion portion that protrudes downward of the operation unit on a side of the operation unit that faces the opening/closing unit, and the support means includes a hook portion that hooks the fixing portion in the released state.

5. The recording apparatus according to claim 3, wherein a coupling portion that is coupled with the opening/closing unit in the operation unit is provided in an upper portion of the operation unit and the fixing portion is provided in a lower portion of the operation unit.

6. The recording apparatus according to claim 1, wherein the support means is provided below the opening/closing unit and above the recording mechanism unit.

7. The recording apparatus according to claim 1, wherein the opening/closing unit includes a reading mechanism unit that reads a document and a feed mechanism unit that automatically feeds a document to the reading mechanism unit.

8. The recording apparatus according to claim 1, wherein the support means constrains translational motion of the operation unit in at least two axial directions, but leaves unconstrained translational motion of the operation unit in an upward direction relative to the recording mechanism unit.

9. The recording apparatus according to claim 1, wherein the operation unit is removable from the support means such that the operation unit is movable to different locations of the recording apparatus.

* * * * *